US009651267B2

(12) United States Patent
Tamaki et al.

(10) Patent No.: US 9,651,267 B2
(45) Date of Patent: May 16, 2017

(54) COOLING AND HOT WATER SUPPLY SYSTEM AND COOLING AND HOT WATER SUPPLY METHOD

(75) Inventors: Shogo Tamaki, Tokyo (JP); Makoto Saito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 618 days.

(21) Appl. No.: 13/817,914

(22) PCT Filed: Mar. 8, 2011

(86) PCT No.: PCT/JP2011/055373
§ 371 (c)(1),
(2), (4) Date: Feb. 20, 2013

(87) PCT Pub. No.: WO2012/039153
PCT Pub. Date: Mar. 29, 2012

(65) Prior Publication Data

US 2013/0145786 A1 Jun. 13, 2013

(30) Foreign Application Priority Data

Sep. 21, 2010 (JP) ..... 2010-210446

(51) Int. Cl.
*F25B 1/00* (2006.01)
*F25B 49/00* (2006.01)
(Continued)

(52) U.S. Cl.
CPC ..... *F24D 19/1051* (2013.01); *F24D 19/1054* (2013.01); *F24F 5/0096* (2013.01);
(Continued)

(58) Field of Classification Search
CPC ..... F24D 19/1051; F24D 19/1054; F25B 29/003; F25B 13/00; F24F 11/0012; F24F 5/0096; F24F 11/06
See application file for complete search history.

(56) References Cited

U.S. PATENT DOCUMENTS 4,557,417 A * 12/1985 Ruby ..... 236/46 R
4,592,206 A * 6/1986 Yamazaki et al. ..... 62/160
(Continued)

FOREIGN PATENT DOCUMENTS

EP 0151493 A2 8/1985
JP 60-240968 A 11/1985
(Continued)

OTHER PUBLICATIONS

Aizawa et al., Heat Pump Hot Water Feeding Machine, Mar. 5, 1999, JPH1163726A, Whole Document.*
(Continued)

*Primary Examiner* — Larry Furdge
(74) *Attorney, Agent, or Firm* — Posz Law Group, PLC

(57) ABSTRACT

A combined air-conditioning and hot water supply system simultaneously executes the cooling operation of a use unit and the hot water supply operation of a hot water supply unit, wherein the combined air-conditioning and hot water supply system operates in a cooling priority mode when the temperature differential $\Delta T_{wm}$ between a set hot water supply temperature $T_{wset}$ and the inlet water temperature $T_{wi}$ of a plate water-heat exchanger is smaller than a priority operation determination threshold M that is set in advance, and operates in a hot water supply priority mode when the temperature differential $\Delta T_{wm}$ becomes equal to or higher than the priority operation determination threshold M. This simultaneous execution of cooling and hot water supply operations prevents hot water from running out.

15 Claims, 10 Drawing Sheets

(51) Int. Cl.

| | |
|---|---|
| ***F24D 19/10*** | (2006.01) |
| ***F25B 13/00*** | (2006.01) |
| ***F24F 5/00*** | (2006.01) |
| ***F24F 11/00*** | (2006.01) |
| ***F25B 29/00*** | (2006.01) |
| *F24F 11/06* | (2006.01) |

(52) U.S. Cl.

CPC ..... *F24F 11/0012* (2013.01); *F25B 13/00* (2013.01); *F25B 29/003* (2013.01); *F24D 2220/042* (2013.01); *F24D 2240/26* (2013.01); *F24F 11/06* (2013.01); *F25B 2313/003* (2013.01); *F25B 2313/0231* (2013.01); *F25B 2313/02731* (2013.01); *F25B 2313/02741* (2013.01)

(56) References Cited

U.S. PATENT DOCUMENTS

| | | | | |
|---|---|---|---|---|
| 5,050,394 | A * | 9/1991 | Dudley et al. | 62/115 |
| 5,065,593 | A * | 11/1991 | Dudley et al. | 62/182 |
| 5,799,498 | A * | 9/1998 | Park | 62/154 |
| 5,960,857 | A * | 10/1999 | Oswalt et al. | 165/11.1 |
| 5,968,393 | A * | 10/1999 | Demaline | 219/492 |
| 2005/0269419 | A1* | 12/2005 | Neranjan et al. | 236/51 |

FOREIGN PATENT DOCUMENTS

| | | | | |
|---|---|---|---|---|
| JP | 61-107065 | A | | 5/1986 |
| JP | 61-107066 | A | | 5/1986 |
| JP | 01-159569 | A | | 6/1989 |
| JP | 06-76864 | B2 | | 9/1994 |
| JP | H1163726 | A | * | 3/1999 |
| JP | 2001-248937 | A | | 9/2001 |
| JP | 2001248937 | A | * | 9/2001 |
| JP | 2006071151 | A | * | 3/2006 |
| JP | 2010-196955 | A | | 9/2010 |

OTHER PUBLICATIONS

Hidemine, Storage Type Hot Water Supply Heating Device, Mar. 16, 2006, JP2006071151A, Whole Document.*

Yasuji et al., Heat Pump Hot Water Supply Air Conditioner, Sep. 14, 2001, JP2001248937, Whole Document.*

International Search Report of the International Searching Authority mailed Apr. 12, 2011 for the corresponding international application No. PCT/JP2011/55373 (with English translation).

Extended European Search Report dated Sep. 23, 2014 issued in corresponding EP patent application No. 11826599.0.

Office Action dated May 28, 2015 in the corresponding with EP Application No. 11 826 599.0.

* cited by examiner

FIG. 4

| | COOLING ONLY OPERATION (COOLING) | SIMULTANEOUS HEATING AND HOT WATER SUPPLY OPERATION (HOT WATER SUPPLY + HEATING) | SIMULTANEOUS COOLING AND HOT WATER SUPPLY OPERATION (HOT WATER SUPPLY + COOLING) |
|---|---|---|---|
| FIRST FOUR-WAY VALVE 2 | SOLID LINE | BROKEN LINE | BROKEN LINE |
| SECOND FOUR-WAY VALVE 13 | SOLID LINE | BROKEN LINE | SOLID LINE |

FIG. 10

| | COOLING ONLY OPERATION (COOLING) | SIMULTANEOUS HEATING AND HOT WATER SUPPLY OPERATION (HOT WATER SUPPLY + HEATING) | SIMULTANEOUS COOLING AND HOT WATER SUPPLY OPERATION (HOT WATER SUPPLY + COOLING) |
|---|---|---|---|
| THIRD FOUR-WAY VALVE 23 | SOLID LINE | BROKEN LINE | SOLID LINE |
| AIR-CONDITIONING DISCHARGE SOLENOID VALVE 22 | OPENED | OPENED | CLOSED |
| HOT WATER SUPPLY DISCHAR -GE SOLENOID VALVE 25 | CLOSED | OPENED | OPENED |
| LOW-PRESSURE EQUALIZING SOLENOID VALVE 27 | CLOSED | CLOSED | OPENED |

FIG. 11
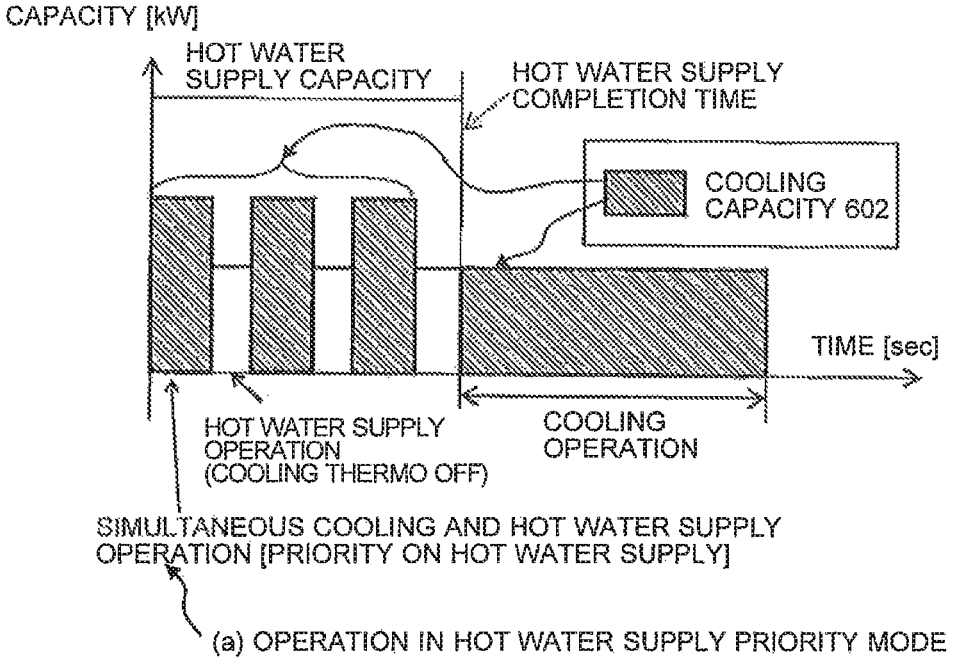
(a) OPERATION IN HOT WATER SUPPLY PRIORITY MODE
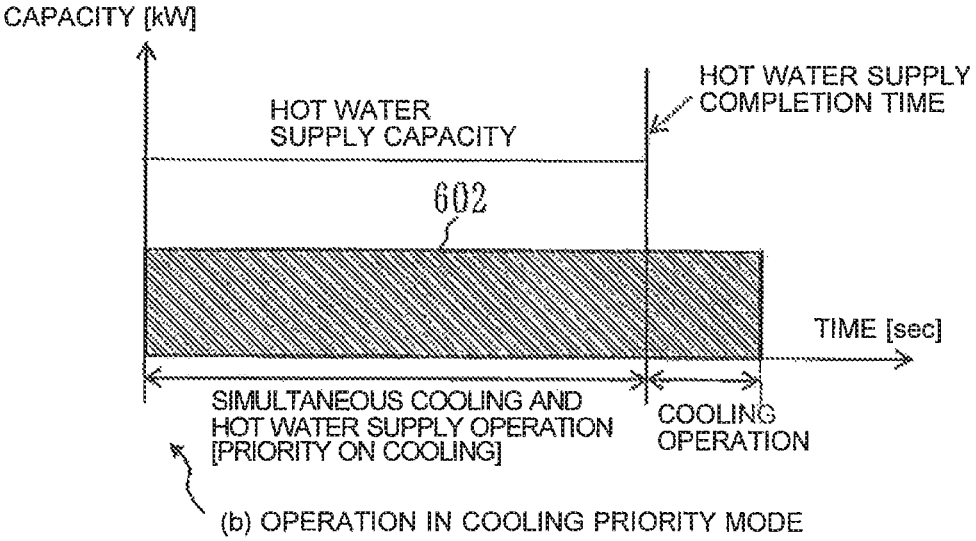
(b) OPERATION IN COOLING PRIORITY MODE

COOLING AND HOT WATER SUPPLY SYSTEM AND COOLING AND HOT WATER SUPPLY METHOD

CROSS REFERENCE TO RELATED APPLICATIONS

This application is a U.S. national stage application of PCT/JP2011/55373 filed on Mar. 8, 2011, and claims priority to, and incorporates by reference, Japanese Patent Application No. 2010-210446 filed on Sep. 21, 2010.

TECHNICAL FIELD

The present invention relates to a combined air-conditioning and hot water supply system that can execute an air-conditioning operation (cooling operation/heating operation) and a hot water supply operation simultaneously. More specifically, the present invention relates to a combined air-conditioning and hot water supply system which, by controlling an operation of a compressor, maintains high efficiency and indoor comfort, prevents hot water supply completion time to become long, and prevents hot water to become short of supply.

BACKGROUND ART

Conventionally, there have existed combined air-conditioning and hot water supply systems that are equipped with a refrigerant circuit formed by connecting a use unit (indoor unit) and a hot water supply unit (hot water supply device) to a heat source unit (outdoor unit) by pipes, thereby enabling an air-conditioning operation and a hot water supply operation to be executed at the same time (see, for example, Patent Literatures 1 to 3).

In these combined air-conditioning and hot water supply systems, conventionally, a plurality of use units (indoor units) are connected to a heat source unit (outdoor unit) via connecting pipes (refrigerant pipes), thereby allowing individual use units to execute a cooling operation or a heating operation. In addition, by connecting the hot water supply unit to a heat source side unit by connecting pipes (refrigerant pipes) or a cascade system, the hot water supply unit can perform hot water supply operation. That is, the air-conditioning operation of a use-side unit and the hot water supply operation of the hot water supply unit can be executed simultaneously. Also, in combined air-conditioning and hot water supply systems, hot water supply operation is executed in the hot water supply unit when cooling operation is being executed in the use unit. Therefore, waste heat generated in the cooling operation can be recovered, thereby achieving highly efficient operation.

CITATION LIST

Patent Literature

Patent Literature 1: Japanese Unexamined Patent Application Publication No. 1-159569

Patent Literature 2: Japanese Examined Patent Application Publication No. 6-76864

Patent Literature 3: Japanese Unexamined Patent Application Publication No. 2001-248937

SUMMARY OF INVENTION

Technical Problem

Relating to the combined air-conditioning and hot water supply system described in Patent Literature 1, the time required for hot water supply is computed on the basis of the average temperature of hot water in a hot water supply tank, a set hot water supply temperature, and heating capacity, and the starting time of hot water supply is computed by advancing the time set by a timer by the time required for hot water supply. In this method, the heating capacity is always constant. Consequently, if the heating capacity is set to a large value, hot water supply needs to be executed in a low-efficiency operational state.

In the combined air-conditioning and hot water supply system described in Patent Literature 2, the maximum set hot water supply temperature is calculated from the total cooling load of a plurality of indoor units, and hot water is supplied with the maximum set hot water supply temperature as a set hot water supply temperature. In this method, there is no need to determine the operating frequency of the compressor so that the cooling capacity equals the total cooling load and process excess waste heat through indoor-outdoor heat exchange. Therefore, although a simultaneous cooling and hot water supply operation can be executed with high efficiency, the simultaneous cooling and hot water supply operation is not executed during hot water supply at high temperature, leading to low efficiency. Also, when the total cooling load is small, the cooling capacity is small, and the hot water supply capacity also becomes small. Thus, it takes a long time for hot water supply to be completed, and there is a possibility that hot water may run out.

In the combined air-conditioning and hot water supply system described in Patent Literature 3, the operating frequency of the compressor is controlled to a fixed value when the cooling load in the indoor unit is small, and the operating frequency of the compressor is controlled in accordance with the cooling load when the cooling load is large. In this method, when the cooling load is small and the quantity of heat required for hot water supply is small, even though it does not take much time for the hot water supply to be completed, the operating frequency of the compressor is controlled to be relatively high with respect to the cooling load, resulting in a low-efficiency operation.

According to the present invention, during simultaneous cooling and hot water supply operation, when the temperature differential $\Delta T_{wm}$ between the inlet water temperature and the set hot water supply temperature is small, a control section controls the operating frequency of the compressor so that the cooling capacity and the cooling load in the use unit become equal, and when the temperature differential $\Delta T_{wm}$ is large, the control section controls the operating frequency of the compressor in accordance with a hot water supply request from the hot water supply unit. An object of the present invention is to provide a combined air-conditioning and hot water supply system that executes this control to recover waste heat generated in cooling for hot water supply with high efficiency and, without compromising the cooled indoor comfort, prevent the hot water supply completion time from becoming long, thereby preventing running out of hot water.

Solution to Problem

A cooling and hot water supply system according to the present invention includes:

a heat source unit that has a compressor whose operating frequency can be controlled and a first heat exchanger;

a use unit that is connected to the heat source unit, the use unit having a second heat exchanger;

a hot water supply unit that is connected to the heat source unit, the hot water supply unit having a water-heat exchanger that heats water in a hot water supply tank by heating water in a water circuit in which the water circulates;

a measuring section that detects an inlet water temperature $T_{wi}$ of water entering the water-heat exchanger in the water circuit, a suction air temperature of air sucked by the use unit, and a water temperature in the hot water supply tank; and a control section that executes a simultaneous operation of a cooling operation using the second heat exchanger and a hot water supply operation using the water-heat exchanger, when the control section receives both a cooling request signal that requests the cooling operation of the use unit and a hot water supply request signal that requests the hot water supply operation of the hot water supply unit, by causing a discharge refrigerant discharged from the compressor to pass through the second heat exchanger from the water-heat exchanger.

While the control section simultaneously executes the cooling operation and the hot water supply operation, the control section executes:

a cooling priority mode when a temperature differential $\Delta T_{wm}$ between a set hot water supply temperature $T_{wset}$ that is held in advance, and the inlet water temperature $T_{wi}$ detected by the measuring section is smaller than a priority operation determination threshold M that is set in advance, the cooling priority mode being a mode that controls an operating frequency of the compressor in accordance with a temperature differential between the suction air temperature detected by the measuring section and a cooling set temperature of the use unit that is held in advance; and a hot water supply priority mode when the temperature differential $\Delta T_{wm}$ is equal to or more than the priority operation determination threshold M, the hot water supply priority mode being a mode that controls the operating frequency of the compressor in accordance with a temperature differential between the set hot water supply temperature $T_{wset}$ and the water temperature in the hot water supply tank detected by the measuring section.

Advantageous Effects of Invention

According to the cooling and hot water supply system of the present invention, waste heat generated in cooling is recovered for hot water supply with high efficiency and, while maintaining indoor comfort, it is possible to prevent the hot water supply completion time from becoming long, thereby preventing running out of hot water.

BRIEF DESCRIPTION OF DRAWINGS

FIG. 4 illustrates details of operations of four-way valves with respect to the operation modes of a heat source unit 301 according to Embodiment 1.

FIG. 10 illustrates details of operations of a four-way valve and the like with respect to the operation modes of the heat source unit 301 according to Embodiment 2.

FIG. 11 is a schematic diagram of the operational states of the hot water supply priority mode and cooling priority mode in the simultaneous cooling and hot water supply operation mode of the combined air-cooling and hot water supply system 200 according to Embodiment 2.

DESCRIPTION OF EMBODIMENTS

Embodiment 1

Figure 1:
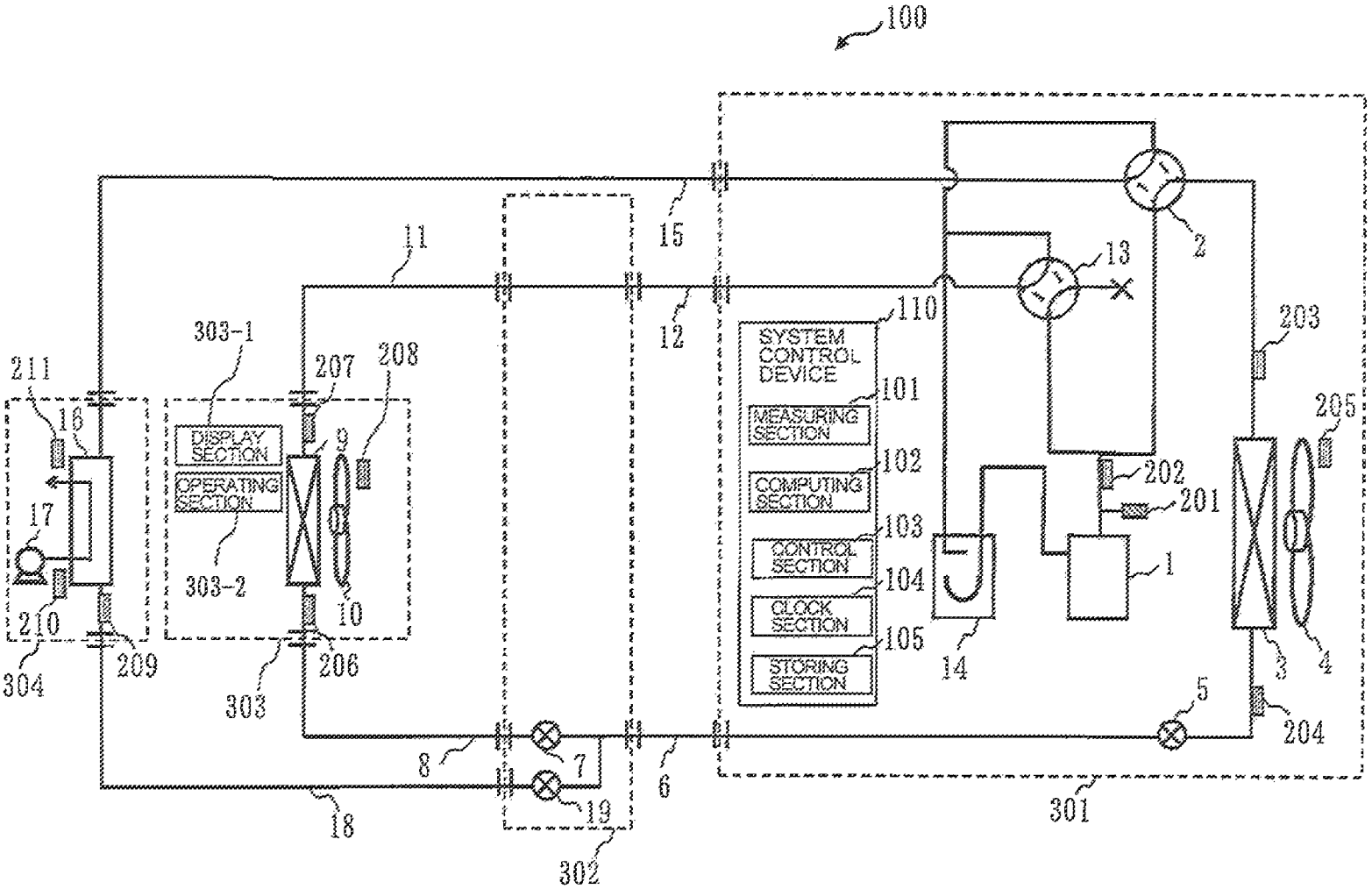
FIG. 1 is a refrigerant circuit diagram of a combined air-conditioning and hot water supply system 100 according to Embodiment 1.

Hereinafter, Embodiment 1 will be described with reference to FIGS. 1 to 8. FIG. 1 is a refrigerant circuit diagram of a combined air-conditioning and hot water supply system 100 (cooling and hot water supply system) according to Embodiment 1. In the drawings below including FIG. 1, the relative sizes of various components may differ from the actual ones. Also, in this specification, for those symbols used in formulas which appear for the first time in the specification, the units of the symbols are written inside [ ]. Dimensionless quantities (no units) will be represented as [-].

Figure 2:
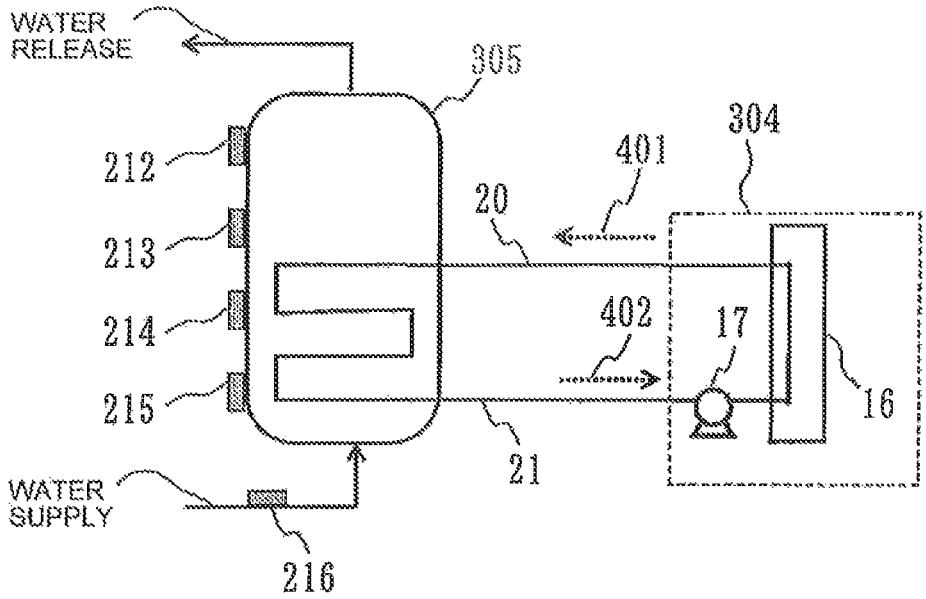
FIG. 2 is a schematic diagram illustrating the flow of water from a hot water supply unit 304 to a hot water supply tank 305 in the combined air-conditioning and hot water supply system 100 according to Embodiment 1.
Figure 3:
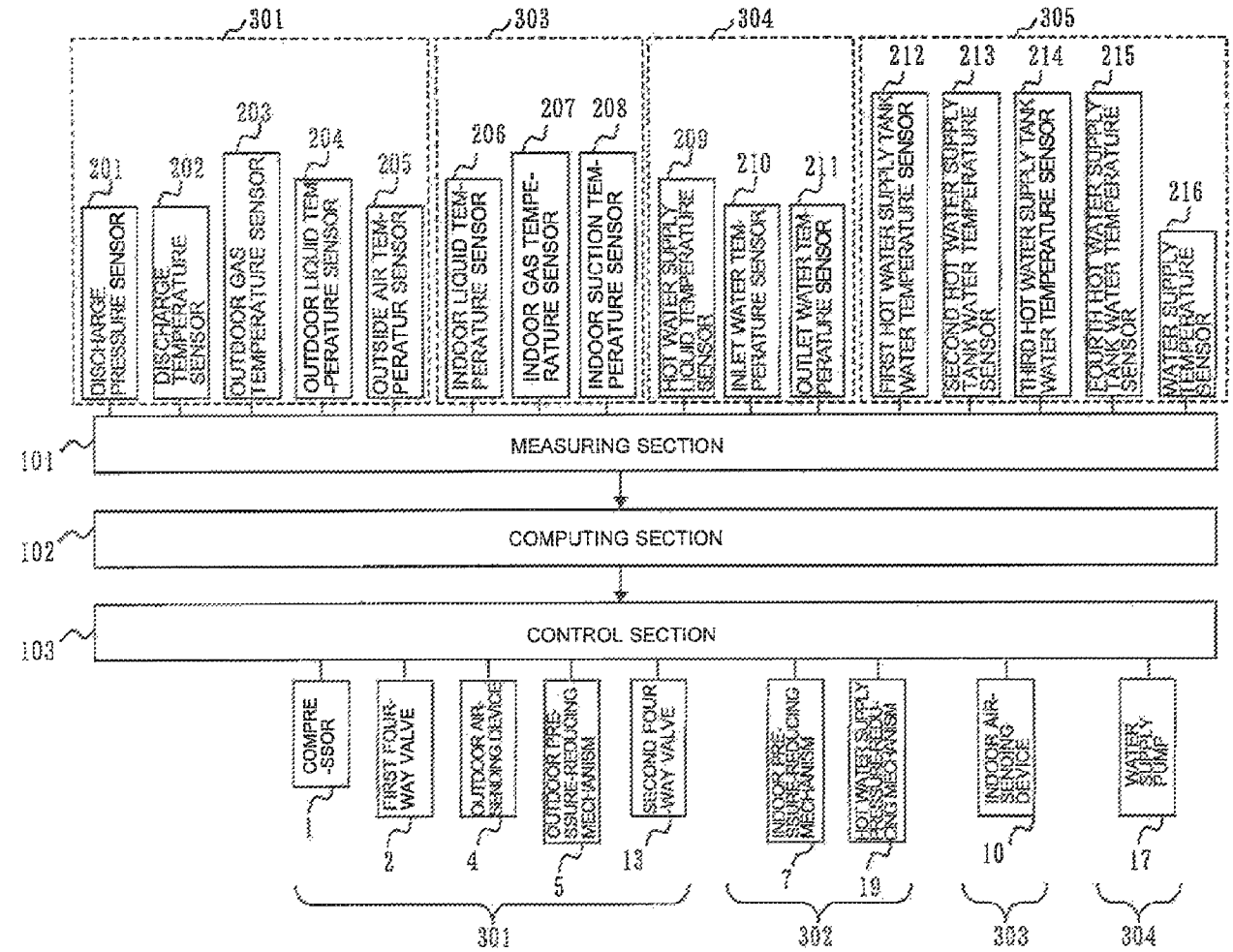
FIG. 3 is a schematic diagram illustrating various sensors, a measuring section 101, a computing section 102, and a control section 103 of the combined air-conditioning and hot water supply system 100 according to Embodiment 1.

FIG. 2 is a schematic diagram illustrating the flow of water from a hot water supply unit 304 to a hot water supply tank 305 in the combined air-conditioning and hot water supply system 100. Broken line arrows 401, 402 each indicate the flow direction of water. Also, FIG. 3 is a schematic diagram illustrating various sensors, a measuring section 101, a computing section 102, and a control section 103 of the combined air-conditioning and hot water supply system 100. Hereinafter, the configuration of the combined air-conditioning and hot water supply system 100 will be described with reference to FIGS. 1 to 3.

The combined air-conditioning and hot water supply system 100 is a three-pipe multi-system combined air-conditioning and hot water supply system that can simultaneously handle a selected cooling operation or heating operation in a use unit and a hot water supply operation in a hot water supply unit, by carrying out a vapor compression refrigeration cycle operation. The combined air-conditioning and hot water supply system 100 executes a hot water supply operation in the hot water supply unit when a cooling operation is being performed, thereby enabling recovery of waste heat generated in the cooling operation. Thus, the combined air-conditioning and hot water supply system 100 is highly efficient, and can prevent running out of hot water by ensuring that it does not take a long time to complete hot water supply.

<Device Configuration>

The combined air-conditioning and hot water supply system 100 has a heat source unit 301, a branch unit 302, a use unit 303, the hot water supply unit 304, and the hot water supply tank 305. The heat source unit 301 and the branch unit 302 are connected via a liquid extension pipe 6 that is a refrigerant pipe, and a gas extension pipe 12 that is a refrigerant pipe. One side of the hot water supply unit 304 is connected to the heat source unit 301 via a hot water supply gas extension pipe 15 that is a refrigerant pipe, and the other side is connected to the branch unit via a hot water supply liquid pipe 18 that is a refrigerant pipe. The use unit 303 and the branch unit 302 are connected via an indoor gas pipe 11 that is a refrigerant pipe, and an indoor liquid pipe 8 that is a refrigerant pipe. Also, the hot water supply tank 305 and the hot water supply unit 304 are connected by an upstream water pipe 20 that is a water pipe, and a downstream water pipe 21 that is a water pipe.

While Embodiment 1 is directed to a case where a single heat source unit 1 is connected with a single use unit, a single hot water supply unit, and a single hot water supply tank, the present invention is not limited to this case. The numbers of these components may be more than or equal to, or less than or equal to those illustrated in the drawings. Also, the refrigerant used in the combined air-conditioning and hot water supply system 100 is, for example, a HFC (hydrofluorocarbon) refrigerant such as R410A, R407C, or R404A, a HCFC (hydrochlorofluorocarbon) refrigerant such as R22 or R134a, or a natural refrigerant such as carbon hydride, helium, or carbon dioxide.

Also, the combined air-conditioning and hot water supply system 100 includes a system control device 110 as illustrated in FIG. 1. The system control device 110 includes the measuring section 101, the computing section 102, the control section 103, a clock section 104, and a storing section 105. While the system control device 110 is arranged in the heat source unit 301 in FIG. 1, this is merely an example. The location where the system control device 110 is arranged is not limited.

<Operation Modes of Heat Source Unit 301>

Operations modes that can be executed by the combined air-conditioning and hot water supply system 100 will be briefly described. In the combined air-conditioning and hot water supply system 100, the operation mode of the heat source unit 301 is determined in accordance with the ratio between the hot water supply load in the connected hot water supply unit 304 and the cooling load or heating load in the connected use unit 303. The combined air-conditioning and hot water supply system 100 is capable of executing three operation modes described below (a cooling operation mode, a simultaneous heating and hot water supply operation mode, and a simultaneous cooling and hot water supply operation mode).

The cooling operation mode is the operation mode of the heat source unit 301 when there is no hot water supply request signal (described later) and the use unit 303 executes a cooling operation. The simultaneous heating and hot water supply operation mode is the operation mode of the heat source unit 301 when executing a simultaneous operation of a heating operation by the use unit 303 and a hot water supply operation by the hot water supply unit 304. The simultaneous cooling and hot water supply operation mode is the operation mode of the heat source unit 301 when executing a simultaneous operation of a cooling operation by the use unit 303 and a hot water supply operation by the hot water supply unit 304.

<Use Unit 303>

The use unit 303 is connected to the heat source unit 301 via the branch unit 302. The use unit 303 is installed in a location that allows the use unit 303 to blow conditioned air to an air-conditioned area (e.g. concealed or suspended on the ceiling inside a building, or hung on the wall surface). The use unit 303 is connected to the heat source unit 301 via the branch unit 302, the liquid extension pipe 6, and the gas extension pipe 12, and constitutes a part of the refrigerant circuit.

The use unit 303 includes an indoor-side refrigerant circuit that constitutes a part of the refrigerant circuit. This indoor-side refrigerant circuit is configured by an indoor heat exchanger 9 (second heat exchanger) that serves as a use-side heat exchanger. Also, the use unit 303 is provided with an indoor air-sending device 10 for supplying conditioned air that has exchanged heat with the refrigerant passing through the indoor heat exchanger 9 to an air-conditioned area such as an indoor area.

The indoor heat exchanger 9 can be configured by, for example, a cross-fin type fin-and-tube heat exchanger including a heat-transfer tube and a number of fins. Also, the indoor heat exchanger 9 may be configured by a micro-channel heat exchanger, a shell-and-tube heat exchanger, a heat-pipe heat exchanger, or a double-pipe heat changer. When the use unit 303 executes the cooling operation mode and the simultaneous cooling and hot water supply operation mode, the indoor heat exchanger 9 functions as an evaporator of the refrigerant to cool the air in the air-conditioned area, and when the use unit 303 executes the simultaneous heating and hot water supply mode, the indoor heat exchanger 9 functions as a condenser (radiator) of the refrigerant to heat the air in the air-conditioned area.

The indoor air-sending device 10 has the function of causing indoor air to be sucked into the use unit 303, and after making the indoor air exchange heat with the refrigerant in the indoor heat changer 9, supplying the air to the air-conditioned area as conditioned air. That is, in the use unit 303, heat can be exchanged between the indoor air taken in by the indoor air-sending device 10, and the refrigerant flowing through the indoor heat exchanger 9. The indoor air-sending device 10 is configured to be able to vary the flow rate of conditioned air supplied to the indoor heat exchanger 9. For example, the indoor air-sending device 10 includes a fan such as a centrifugal fan or a multi-blade fan, and a motor that drives this fan, for example, a DC fan motor.

Further, the use unit 303 is provided with various sensors described below:

(1) an indoor liquid temperature sensor 206 that is provided on the liquid side of the indoor heat exchanger 9, and detects the temperature of a liquid refrigerant;

(2) an indoor gas temperature sensor 207 that is provided on the gas side of the indoor heat exchanger 9, and detects the temperature of a gas refrigerant; and (3) an indoor suction temperature sensor 208 that is provided on the suction port side of the indoor air of the use unit 303, and detects the temperature of the indoor air entering the unit.

As illustrated in FIG. 3, the operation of the indoor air-sending device 10 is controlled by the control section 103 that functions as normal operation control means for performing normal operation of the use unit 303 including the cooling operation mode and the heating operation mode.

<Hot Water Supply Unit 304>

The hot water supply unit 304 is connected to the heat source unit 301 via the branch unit 302. As illustrated in FIG. 2, the hot water supply unit 304 has the function of supplying hot water to the hot water supply tank 305 that is installed outside a building, for example, and heating and boiling up the water in the hot water supply tank 305. Also, one side of the hot water supply unit 304 is connected to the heat source unit 301 via the hot water supply gas extension pipe 15, and the other side is connected to the branch unit 302 via the hot water supply liquid pipe 18. The hot water supply unit 304 constitutes a part of the refrigerant circuit in the combined air-conditioning and hot water supply system 100.

The hot water supply unit 304 includes a hot water supply-side refrigerant circuit that constitutes a part of the refrigerant circuit. This hot water supply-side refrigerant circuit has a plate water-heat exchanger 16 (water-heat exchanger) as its functional constituent. Also, the hot water supply unit 304 is provided with a water supply pump 17 for supplying hot water that has exchanged heat with the refrigerant in the plate water-heat exchanger 16 to the hot water supply tank or the like.

In the hot water supply operation mode executed by the hot water supply unit 304, the plate water-heat exchanger 16 functions as a condenser (or radiator) of the refrigerant, and heats water that is supplied by the water supply pump 17. The water supply pump 17 has the function of supplying water into the hot water supply unit 304, causing the water to exchange heat in the plate water-heat exchanger 16 and turn into hot water, and thereafter supplying the hot water into the hot water supply tank 305 for heat exchange with the water in the hot water supply tank 305. That is, in the hot water supply unit 304, heat can be exchanged between the water supplied from the water supply pump 17 and the refrigerant flowing through the plate water-heat exchanger 16, and also heat can be exchanged between the water supplied from the water supply pump 17 and the water in the hot water supply tank 305. Also, the hot water supply unit 304 is configured to be able to vary the flow rate of water supplied to the plate water-heat exchanger 16.

Also, the hot water supply unit 304 is provided with various sensors described below:

(1) a hot water supply liquid temperature sensor 209 that is provided on the liquid side of the plate water-heat exchanger 16, and detects the temperature of a liquid refrigerant;

(2) an inlet water temperature sensor 210 that is provided on the water inlet side of the hot water supply unit 304, and detects the temperature of water entering the unit; and (3) an outlet water temperature sensor 211 that is provided on the water outlet side of the hot water supply unit 304, and detects the temperature of water exiting the unit.

As illustrated in FIG. 3, the operation of the water supply pump 17 is controlled by the control section 103 that functions as normal operation control means for performing normal operation of the hot water supply unit 304 including the hot water supply operation mode.

<Hot Water Supply Tank 305>

The hot water supply tank is installed outside a building, for example, and has the function of storing hot water boiled up by the hot water supply unit 304. One side of the hot water supply tank 305 is connected to the hot water supply unit 304 via the upstream water pipe 20, and the other side is connected to the hot water supply unit 304 via the downstream water pipe 21. The hot water supply tank 305 constitutes a part of a water circuit 304-1 in the combined air-conditioning and hot water supply system 100. That is, as illustrated in FIG. 2, the upstream water pipe 20, the downstream water pipe 21, and the water supply pump 17 constitute the water circuit 304-1 in which the water to be heated by the plate water-heat exchanger 16 circulates. The hot water supply tank 305 is of an always-full type. As the user consumes water, hot water is released from the top of the tank, and city water is supplied from the bottom of the tank in accordance with the amount of released hot water.

The water fed by the water supply pump 17 in the hot water supply unit 304 is heated by the refrigerant in the plate water-heat exchanger 16 and turns into hot water, and enters the hot water supply tank 305 via the upstream water pipe 20. The hot water that has entered the hot water supply tank 305 exchanges heat with the water in the tank and turns into cold water. After exiting the hot water supply tank 305, the cold water enters the hot water supply unit 304 again via the downstream water pipe 21. After being fed again by the water supply pump 17, the cold water turns into hot water in the plate water-heat exchanger 16. Through this process, hot water is boiled up in the hot water supply tank 305. While hot water is boiled up indirectly according to the specifications in FIG. 2, alternatively, the specifications may be such that hot water in the hot water supply tank 305 is fed to the hot water supply unit 304 and heated, thereby directly boiling up hot water.

Also, the hot water supply tank 305 is provided with various sensors described below:

(1) a first hot water supply tank water temperature sensor 212 that is provided on an upper side surface of the hot water supply tank 305, and detects hot water supply temperature in an upper portion of the tank;

(2) a second hot water supply tank water temperature sensor 213 that is provided below the first hot water supply tank water temperature sensor 212, and detects hot water supply temperature in a portion of the tank located below the installation position of the first hot water supply tank water temperature sensor 212; (3) a third hot water supply tank water temperature sensor 214 that is provided below the second hot water supply tank water temperature sensor 213, and detects hot water supply temperature in a portion of the tank located below the installation position of the second hot water supply tank water temperature sensor 213; (4) a fourth hot water supply tank water temperature sensor 215 that is provided on an lower side surface of the hot water supply tank 305, and detects hot water supply temperature in a lower portion of the tank; and (5) a water supply temperature sensor 216 that detects the temperature of water supplied from the bottom of the hot water supply tank 305.

<Heat Source Unit 301>

The heat source unit 301 is installed outside a building, for example. The heat source unit 301 is connected to the use unit 303 via the liquid extension pipe 6, the gas extension pipe 12, and the branch unit 302. Also, the heat source unit 301 is connected to the hot water supply unit 304 via the hot water supply gas extension pipe 15, the liquid extension pipe 6, and the branch unit 302. The heat source unit 301 constitutes a part of the refrigerant circuit in the combined air-conditioning and hot water supply system 100.

The heat source unit 301 includes an outdoor-side refrigerant circuit that constitutes a part of the refrigerant circuit. This outdoor-side refrigerant circuit has, as its constituent devices, a compressor 1 that compresses the refrigerant, two four-way valves (a first four-way valve 2 and a second four-way valve 13) for switching the direction of flow of the refrigerant in accordance with the outdoor operation mode, an outdoor heat exchanger 3 (a first heat exchanger) serving as a heat source side heat exchanger, and an accumulator 14 for storing excess refrigerant. Also, the heat source unit 301 includes an outdoor air-sending device 4 for supplying air to the outdoor heat exchanger 3, and an outdoor pressure-reducing mechanism (heat source-side pressure-reducing mechanism) 5 for controlling the flow rate of the refrigerant to be distributed.

The compressor 1 sucks a refrigerant, and compresses the refrigerant into a high-temperature high-pressure state. The compressor 1 that is equipped in Embodiment 1 is capable of varying its operation capacity, and is configured by, for example, a positive displacement compressor that is driven by a motor (not illustrated) controlled by an inverter. While Embodiment 1 is directed to a case where there is only one compressor 1, the present invention is not limited to this. Depending on the connected number of use units 303 and hot water supply units 304, or the like, two or more compressors 1 may be connected in parallel. Also, the discharge-side pipe connected to the compressor 1 is branched midway such that one side is connected to the gas extension pipe 12 via the second four-way valve 13, and the other side is connected to the hot water supply gas extension pipe 15 via the first four-way valve 2.

The first four-way valve 2 and the second four-way valve 13 each function as a flow switching device that switches the direction of flow of the refrigerant in accordance with the operation mode of the heat source unit 301.

FIG. 4 illustrates details of operations of the four-way valves with respect to the operation modes. The "solid line" and "broken line" indicated in FIG. 4 refer to the "solid line" and "broken line" illustrated in FIG. 1 that represents the switching states of the first four-way valve 2 and second four-way valve 13, respectively.

The first four-way valve 2 is switched to the "solid line" in a cooling only operation mode. That is, in the cooling only operation mode, in order to make the outdoor heat exchanger 3 function as a condenser for the refrigerant that is compressed in the compressor 1, the first four-way valve 2 is switched so as to connect the discharge side of the compressor 1 to the gas side of the outdoor heat exchanger 3. Also, the first four-way valve 2 is switched to the "broken line" in the simultaneous heating and hot water supply operation mode or simultaneous cooling and hot water supply operation mode. That is, in the simultaneous heating and hot water supply operation mode or simultaneous cooling and hot water supply operation mode, in order to make the outdoor heat exchanger 3 function as an evaporator for the refrigerant, the first four-way valve 2 is switched so as to connect the discharge side of the compressor 1 to the gas side of the plate water-heat exchanger 16, and connect the suction side of the compressor 1 to the gas side of the outdoor heat exchanger 3.

The second four-way valve 13 is switched to the "solid line" in the cooling only operation mode or simultaneous cooling and hot water supply operation mode. That is, in the cooling only operation mode or simultaneous cooling and hot water supply operation mode, in order to make the indoor heat exchanger 9 function as an evaporator for the refrigerant that is compressed in the compressor 1, the second four-way valve 13 is switched so as to connect the suction side of the compressor 1 to the gas side of the indoor heat exchanger 9. Also, the second four-way valve 13 is switched to the "broken line" in the simultaneous heating and hot water supply operation mode. That is, in the simultaneous heating and hot water supply operation mode, in order to make the indoor heat exchanger 9 function as a condenser for the refrigerant, the second four-way valve 13 is switched so as to connect the discharge side of the compressor 1 to the gas side of the indoor heat exchanger 9.

The gas side of the outdoor heat exchanger 3 is connected to the first four-way valve 2, and the liquid side is connected to an outdoor pressure-reducing mechanism 5. The outdoor heat exchanger 3 can be configured by, for example, a cross-fin type fin-and-tube heat exchanger including a heat-transfer tube and a number of fins. Also, the outdoor heat exchanger 3 may be configured as a micro-channel heat exchanger, a shell-and-tube heat exchanger, a heat-pipe heat exchanger, or a double-pipe heat changer. The outdoor heat exchanger 3 functions as a condenser for the refrigerant to heat the refrigerant in the cooling only operation mode or simultaneous cooling and hot water supply operation mode, and functions as an evaporator for the refrigerant to cool the refrigerant in the simultaneous heating and hot water supply operation mode.

The outdoor air-sending device 4 has the function of sucking the outdoor air into the heat source unit 301, causing the outdoor air to exchange heat in the outdoor heat exchanger 3, and thereafter emitting the air outdoors. That is, in the heat source unit 301, heat can be exchanged between the outside air taken in by the outdoor air-sending device 4, and the refrigerant flowing through the outdoor heat exchanger 3. The outdoor air-sending device 4 is configured to be able to vary the flow rate of air supplied to the outdoor heat exchanger 3. The outdoor air-sending device 4 includes a fan such as a propeller fan, and a motor that drives this fan, for example, a DC fan motor.

The accumulator 14 is provided on the suction side of the compressor 1. The accumulator 14 has the function of storing a liquid refrigerant to prevent liquid backflow to the compressor 1 when an abnormality occurs in the combined air-conditioning and hot water supply system 100 or during the transient response of the operational state caused by a change in operation control.

Also, the heat source unit 301 is provided with various sensors described below:

(1) a high-pressure pressure sensor 201 (high-pressure detecting device) that is provided on the discharge side of the compressor 1, and detects a high-pressure side pressure;

(2) a discharge temperature sensor 202 that is provided on the discharge side of the compressor 1, and detects a discharge temperature;

(3) an outdoor gas temperature sensor 203 that is provided on the gas side of the outdoor heat exchanger 3, and detects a gas refrigerant temperature;

(4) an outdoor liquid temperature sensor 204 that is provided on the liquid side of the outdoor heat exchanger 3, and detects the temperature of a liquid refrigerant; and (5) an outside air temperature sensor 205 that is provided on the suction port side of the outside air of the heat source unit 301, and detects the temperature of the outside air entering the unit.

The operations of the compressor 1, first four-way valve 2, outdoor air-sending device 4, outdoor pressure-reducing mechanism 5, and second four-way valve 13 are controlled by the control section 103 that functions as normal operation control means for performing normal operation including the cooling operation mode, the simultaneous heating and hot water supply operation mode, and the simultaneous cooling and hot water supply operation mode.

<Branch Unit 302>

The branch unit 302 is installed inside a building, for example. The branch unit 302 is connected to the heat source unit 301 via the liquid extension pipe 6 and the gas extension pipe 12, is connected to the use unit 303 via the indoor liquid pipe 8 and the indoor gas pipe 11, and is connected to the hot water supply unit 304 via the hot water supply liquid pipe 18. The branch unit 302 constitutes a part of the refrigerant circuit in the combined air-conditioning and hot water supply system 100. The branch unit 302 has the function of controlling the flow of the refrigerant in accordance with the operation that is being required in each of the use unit 303 and the hot water supply unit 304.

The branch unit 302 includes a branch refrigerant circuit that constitutes a part of the refrigerant circuit. This branch refrigerant circuit has, as its constituent devices, an indoor pressure-reducing mechanism (use-side pressure-reducing mechanism) 7 for controlling the flow rate of the refrigerant to be distributed, and a hot water supply pressure-reducing mechanism 19 for controlling the flow rate of the refrigerant to be distributed.

The indoor pressure-reducing mechanism 7 is provided in the indoor liquid pipe 8. Also, the hot water supply pressure-reducing mechanism 19 is provided in the hot water supply liquid pipe 18 within the branch unit 302. The indoor pressure-reducing mechanism 7 functions as a pressure reducing valve or an expansion valve. In the cooling operation mode or the simultaneous cooling and hot water supply operation mode, the indoor pressure-reducing mechanism 7 reduces the pressure of the refrigerant flowing through the liquid extension pipe 6 to thereby cause the refrigerant to expand, and in the simultaneous heating and hot water supply operation mode, the indoor pressure-reducing mechanism 7 reduces the pressure of the refrigerant flowing through the indoor liquid pipe 8 to thereby cause the refrigerant to expand. The hot water supply pressure-reducing mechanism 19 functions as a pressure reducing valve or an expansion valve. In the simultaneous cooling and hot water supply operation mode or the simultaneous heating and hot water supply operation mode, the hot water supply pressure-reducing mechanism 19 reduces the pressure of the refrigerant flowing through the hot water supply liquid pipe 18 to thereby cause the refrigerant to expand. The indoor pressure-reducing mechanism 7 and the hot water supply pressure-reducing mechanism 19 are each preferably configured so that its opening degree can be variably controlled, for example, precision flow control means formed by an electronic expansion valve, or inexpensive refrigerant flow control means such as a capillary tube.

<System Control Device 110>

As illustrated in FIG. 3, the operation of the hot water supply pressure-reducing mechanism 19 is controlled by the control section 103 of the system control device 110 that functions as normal operation control means for performing normal operation of the hot water supply unit 304 including the hot water supply operation mode. Also, as illustrated in FIG. 3, the operation of the indoor pressure-reducing mechanism 7 is controlled by the control section 103 that functions as normal operation control means for performing normal operation of the use unit 303 including the cooling operation mode and the heating operation mode.

Also, as illustrated in FIG. 3, various quantities detected by various temperature sensors and pressure sensors are inputted to the measuring section 101, and processed in the computing section 102. Then, on the basis of the processing results in the computing section 102, the control section 103 controls the compressor 1, the first four-way valve 2, the outdoor air-sending device 4, the outdoor pressure-reducing mechanism 5, the indoor pressure-reducing mechanism 7, the indoor air-sending device 10, the second four-way valve 13, the water supply pump 17, and the hot water supply pressure-reducing mechanism 19. That is, the operation of the combined air-conditioning and hot water supply system 100 is controlled in a centralized manner by the system control device 110 including the measuring section 101, the computing section 102, and the control section 103. The system control device 110 can be configured by a microcomputer, Calculation formulae in the following description of the embodiments are computed by the computing section 102, and the control section 103 controls various devices such as the compressor 1 in accordance with the computation results.

Specifically, the control section 103 executes various operation modes by controlling the driving frequency of the compressor 1, switching of the first four-way valve 2, the rotation speed (including ON/OFF) of the outdoor air-sending device 4, the opening degree of the outdoor pressure-reducing mechanism 5, the opening degree of the indoor pressure-reducing mechanism 7, the rotation speed (including ON/OFF) of the indoor air-sending device 10, switching of the second four-way valve 13, the rotation speed (including ON/OFF) of the water supply pump 17, and the opening degree of the hot water supply pressure-reducing mechanism 19, on the basis of the operation mode inputted via a remote control (e.g. a cooling request signal that requests the cooling operation of the use unit 303), a hot water supply request signal described later, command regarding a temperature setting or the like, and information detected by various sensors. The measuring section 101, the computing section 102, and the control section 103 may be provided integrally, or may be provided separately. Also, the measuring section 101, the computing section 102, and the control section 103 may be provided in one of the units. Further, the measuring section 101, the computing section 102, and the control section 103 may be provided in each unit.

<Operation Modes>

The combined air-conditioning and hot water supply system 100 executes the cooling operation mode, the simultaneous heating and hot water supply operation mode, and the simultaneous cooling and hot water supply operation mode by controlling various devices equipped to the heat source unit 301, the branch unit 302, the use unit 303, and the hot water supply unit 304 in accordance with each individual operating load required in the use unit 303, and a hot water supply request signal requested to the hot water supply unit 304. The simultaneous cooling and hot water supply operation mode allows waste heat generated in cooling to be used for hot water supply, thereby achieving high efficiency.

Figure 5:
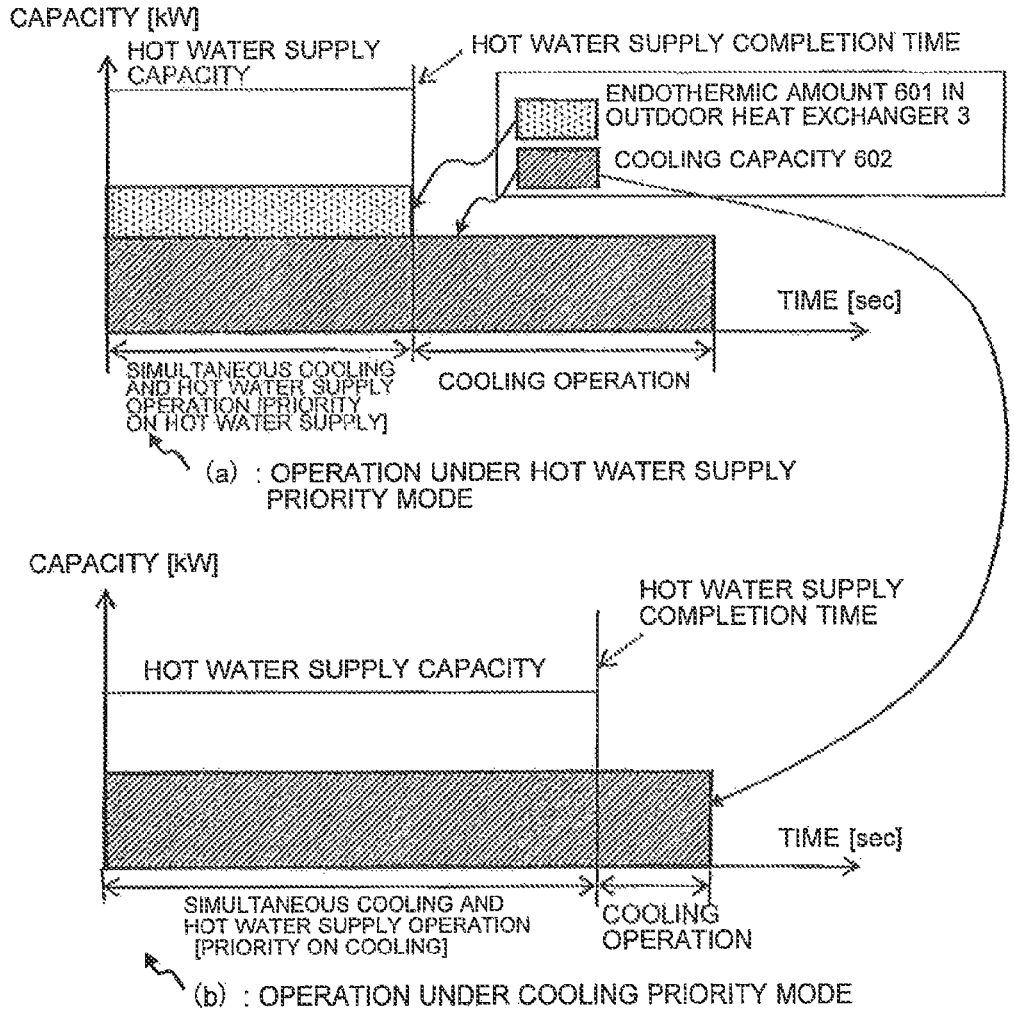
FIG. 5 is a schematic diagram illustrating the operational states of "(a) hot water supply priority mode" and "(b) cooling priority mode" in the simultaneous cooling and hot water supply operation mode of the combined air-conditioning and hot water supply system 100 according to Embodiment 1.

FIG. 5 is a schematic diagram illustrating the operational states of "(a) hot water supply priority mode" and "(b) cooling priority mode" in the simultaneous cooling and hot water supply operation mode of the combined air-conditioning and hot water supply system 100. In "(a) hot water supply priority mode", the relationship between an absorbed heat quantity 601 in the outdoor heat exchanger 3, and a cooling capacity 602 is illustrated. In "(b) cooling priority mode", the cooling capacity 602 is illustrated. As illustrated in FIG. 5, the simultaneous cooling and hot water supply operation mode further includes a "hot water supply priority mode" in which the operating frequency of the compressor 1 is controlled in accordance with a hot water supply request signal from the hot water supply unit 304, and "cooling priority mode" in which the operating frequency of the compressor 1 is controlled in accordance with the cooling load in the use unit 303.

As will be described later with reference to FIG. 6, while executing a cooling operation and a hot water supply operation simultaneously, the control section 103 determines the priority mode from the magnitude relation between a priority operation determination threshold M that is set in advance, and a temperature differential $\Delta T_{wm}$ ($\Delta T_{wm}=T_{wset}-T_{wi}$) between a set hot water supply temperature $T_{wset}$ that is held in advance (received by the control section 103 from a remote control or the hot water supply unit 304, for example), and an inlet water temperature $T_{wi}$ detected by the measuring section 101 (detected by the measuring section 101 via the inlet water temperature sensor 210).

Specifically, the control section 103 operates in the cooling priority mode in a case where $$\Delta T_{wm}<M.$$

The cooling priority mode is a mode in which the control section 103 controls the operating frequency of the compressor 1 in accordance with the indoor suction temperature detected by the measuring section 101 (detected by the measuring section 101 via the indoor suction temperature sensor 208), and the indoor set temperature of the use unit 303 that is held in advance (received by the control section 103 from a remote control or the use unit 303, for example).

Also, the control section 103 operates in the hot water supply priority mode in a case where $$\Delta T_{wm}\geq M.$$

The hot water supply priority mode is a mode in which the control section 103 controls the operating frequency of the compressor 1 in accordance with the temperature differential between the set hot water supply temperature $T_{wset}$, and the water temperature in the hot water supply tank 305 detected by the measuring section 101 (detected by the measuring section 101 via the first hot water supply tank water temperature sensors 212 to 215, and the like).

A hot water supply request signal is outputted by the hot water supply unit 304 when the temperature of water stored in the hot water supply tank 305 is below a set hot water supply temperature. When the hot water supply request signal is outputted, in order to raise the temperature of water in the hot water supply tank to the set hot water supply temperature in as a short time as possible, the control section 103 makes the operating frequency of the compressor 1 higher to increase the hot water supply capacity. Also, in a case where the operating frequency of the compressor 1 is to be controlled in accordance with the cooling load, the cooling load is estimated from the temperature differential (indoor temperature differential) between the indoor suction temperature (suction air temperature) and the indoor set temperature (cooling set temperature), and the operating frequency is controlled by regarding that the larger the indoor temperature differential, the larger the cooling load.

In a case where the simultaneous cooling and hot water supply operation mode is executed in the hot water supply priority mode, the control section 103 determines the operating frequency of the compressor 1 in accordance with a hot water supply request signal from the hot water supply unit 304. For this reason, heat needs to be rejected in the outdoor heat exchanger 3 in order to make the cooling capacity and the cooling load equal. When the hot water supply unit 304 (or the computing section 102) ceases to output a hot water supply request signal and hot water supply is complete, the control section 103 executes a cooling operation. In this operation, the operating frequency of the compressor 1 is raised to increase the hot water supply capacity, thereby completing hot water supply in a short time.

In a case where the simultaneous cooling and hot water supply operation mode is executed in the cooling priority mode, the operating frequency of the compressor 1 is determined in accordance with the cooling load in the use unit 303. Therefore, the cooling capacity and the cooling load become equal, and there is no need to remove heat in the outdoor heat exchanger 3. When there is no longer a hot water supply request signal from the hot water supply unit 304 and hot water supply is complete, the control section 103 executes a cooling operation. In this operation, the operating frequency of the compressor 1 is set lower than that in the hot water supply priority operation, and thus hot water supply can be performed with high efficiency. However, because the hot water supply capacity becomes smaller, it takes time to complete hot water supply.

<Operation>

The specific operations of the cooling operation mode, simultaneous heating and hot water supply operation mode, and simultaneous cooling and hot water supply operation mode executed by the combined air-conditioning and hot water supply system 100 will be described. The operations of the four-way valves in individual operation modes are as illustrated in FIG. 4.

[Cooling Operation Mode]

In the cooling operation mode, the use unit 303 is in the cooling operation mode. In the cooling operation mode, the first four-way valve 2 is in the state indicated by the solid line, that is, a state in which the discharge side of the compressor 1 is connected to the gas side of the outdoor heat exchanger 3. Also, the second four-way valve 13 is in the state indicated by the solid line, that is, a state in which the suction side of the compressor 1 is connected to the indoor heat exchanger 9 via the gas extension pipe 12.

In this state of the refrigerant circuit, the compressor 1, the outdoor air-sending device 4, and the indoor air-sending device 10 are activated. Then, a low-pressure gas refrigerant is sucked into the compressor 1, where the refrigerant is compressed into a high-temperature high-pressure gas refrigerant. Thereafter, the high-temperature high-pressure gas refrigerant enters the outdoor heat exchanger 3 via the first four-way valve 2, where the gas refrigerant is condensed by exchanging heat with the outdoor air supplied by the outdoor air-sending device 4, and turns into a high-pressure gas refrigerant. After exiting the outdoor heat exchanger 3, the refrigerant flows to the outdoor pressure-reducing mechanism 5, where its pressure is reduced. Thereafter, the refrigerant enters the branch unit 302 via the liquid extension pipe 6. At this time, the outdoor pressure-reducing mechanism 5 is being controlled to the maximum opening degree. The refrigerant that has entered the branch unit 302 is reduced in pressure in the indoor pressure-reducing mechanism 7, and turns into a two-phase gas-liquid refrigerant at low pressure, Thereafter, the refrigerant exits the branch unit 302, and enters the use unit 303 via the indoor liquid pipe 8.

The refrigerant that has entered the use unit 303 enters the indoor heat exchanger 9, and is evaporated into a low-pressure gas refrigerant by exchanging heat with the indoor air supplied by the indoor air-sending device 10. The degree of subcooling of the refrigerant on the liquid side of the outdoor heat exchanger 3 is calculated by subtracting the temperature detected by the outdoor liquid temperature sensor 204, from the saturation temperature (condensing temperature) computed from the pressure detected by the high-pressure pressure sensor 201.

The indoor pressure-reducing mechanism 7 controls the flow rate of the refrigerant flowing through the indoor heat exchanger 9 so that the degree of subcooling of the refrigerant on the liquid side of the outdoor heat exchanger 3 becomes a predetermined value. Consequently, the low-pressure gas refrigerant that has been evaporated in the outdoor heat exchanger 3 has a predetermined degree of subcooling. In this way, in the indoor heat exchanger 9, refrigerant flows at a flow rate corresponding to the cooling load required in the conditioned space where the use unit 303 is installed.

The refrigerant that has exited the indoor heat exchanger 9 exits the use unit 303, and flows to the gas extension pipe 12 after passing through the indoor gas pipe 11 and the branch unit 302. The refrigerant then passes through the accumulator 14 via the second four-way valve 13, and is sucked into the compressor 1 again.

The operating frequency of the compressor 1 is controlled by the control section 103 so that in the use unit 303, there is no temperature difference between the indoor set temperature and the indoor suction temperature detected by the indoor suction temperature sensor 208. Also, the air flow of the outdoor air-sending device 4 is controlled by the control section 103 so that the condensing temperature becomes a predetermined value in accordance with the outside air temperature detected by the outside air temperature sensor 205. Here, the condensing temperature is the saturation temperature computed from the pressure detected by the high-pressure pressure sensor 201.

[Simultaneous Heating and Hot Water Supply Operation Mode]

In the simultaneous heating and hot water supply operation mode, the use unit 303 is in the heating operation mode, and the hot water supply unit 304 is in the hot water supply operation mode. In the simultaneous heating and hot water supply operation mode, the first four-way valve 2 is in the state indicated by the broken line, that is, the discharge side of the compressor 1 is connected to the gas side of the plate water-heat exchanger 16, and the suction side of the compressor 1 is connected to the gas side of the outdoor heat exchanger 3. Also, the second four-way valve 13 is in the state indicated by the broken line, that is, the discharge side of the compressor 1 is connected to the gas side of the indoor heat exchanger 9.

In this state of the refrigerant circuit, the compressor 1, the outdoor air-sending device 4, the indoor air-sending device 10, and the water supply pump 17 are activated. Then, a low-pressure gas refrigerant is sucked into the compressor 1, where the gas refrigerant is compressed into a high-temperature high-pressure gas refrigerant. Thereafter, the high-temperature high-pressure gas refrigerant is distributed so as to flow through the first four-way valve 2 or the second four-way valve 13.

The refrigerant that has entered the first four-way valve 2 exits the heat source unit 301, and enters the hot water supply unit 304 via the hot water supply gas extension pipe 15. The refrigerant that has entered the hot water supply unit 304 enters the plate water-heat exchanger 16, where the refrigerant is condensed by exchanging heat with the water supplied by the water supply pump 17 and turns into a high-pressure liquid refrigerant, and exits the plate water-heat exchanger 16. After the refrigerant that has heated the water in the plate water-heat exchanger 16 exits the hot water supply unit 304, the refrigerant enters the branch unit 302 via the hot water supply liquid pipe 18, and is reduced in pressure by the hot water supply pressure-reducing mechanism 19 and turns into a two-phase gas-liquid refrigerant at low pressure. Thereafter, the refrigerant joins the refrigerant that has flown through the indoor pressure-reducing mechanism 7, and exits the branch unit 302.

The hot water supply pressure-reducing mechanism 19 is controlled by the control section 103 to such an opening degree that the degree of subcooling on the liquid side of the plate water-heat exchanger 16 becomes a predetermined value. The degree of subcooling on the liquid side of the plate water-heat exchanger 16 is calculated by computing the saturation temperature (condensing temperature) from the pressure detected by the high-pressure pressure sensor 201, and subtracting the temperature detected by the hot water supply liquid temperature sensor 209 from the saturation temperature. Since the hot water supply pressure-reducing mechanism 19 controls the flow rate of refrigerant flowing through the plate water-heat exchanger 16 so that the degree of subcooling of the refrigerant on the liquid side of the plate water-heat exchanger 16 becomes a predetermined value, the high-pressure liquid refrigerant that has been condensed in the plate water-heat exchanger 16 has a predetermined degree of subcooling. In this way, in the plate water-heat exchanger 16, refrigerant flows at a flow rate corresponding to the hot water supply request requested in accordance with the use condition of hot water in the facility where the hot water supply unit 304 is installed.

Meanwhile, the refrigerant that has entered the second four-way valve 13 exits the heat source unit 301, and flows to the branch unit 302 via the gas extension pipe 12. Thereafter, the refrigerant enters the use unit 303 via the indoor gas pipe 11. The refrigerant that has entered the use unit 303 enters the indoor heat exchanger 9, where the refrigerant is condensed by exchanging heat with the indoor air supplied by the indoor air-sending device 10 and turns into a high-pressure liquid refrigerant, and exits the indoor heat exchanger 9. The refrigerant that has heated the indoor air in the indoor heat exchanger 9 exits the use unit 303, and enters the branch unit 302 via the indoor liquid pipe 8. The refrigerant is then reduced in pressure by the indoor pressure-reducing mechanism 7, and turns into a two-phase gas-liquid or liquid-phase refrigerant at low pressure. Thereafter, the refrigerant joins the refrigerant that has flown through the hot water supply pressure-reducing mechanism 19, and exits the branch unit 302.

The indoor pressure-reducing mechanism 7 is controlled by the control section 103 to such an opening degree that the degree of subcooling on the liquid side of the indoor heat exchanger 9 becomes a predetermined value. The degree of subcooling on the liquid side of the indoor heat exchanger 9 is calculated by computing the saturation temperature (condensing temperature) from the pressure detected by the high-pressure pressure sensor 201, and subtracting the temperature detected by the indoor liquid temperature sensor 206 from the saturation temperature. That is, the indoor pressure-reducing mechanism 7 is controlled by the control section 103 to such an opening degree that the degree of subcooling of the refrigerant on the liquid side of the indoor heat exchanger 9 becomes a predetermined value. Since the indoor pressure-reducing mechanism 7 controls the flow rate of refrigerant flowing through the indoor heat exchanger 9 so that the degree of subcooling of the refrigerant on the liquid side of the indoor heat exchanger 9 becomes a predetermined value, the high-pressure liquid refrigerant that has been condensed in the indoor heat exchanger 9 has a predetermined degree of subcooling. Consequently, in the indoor heat exchanger 9, refrigerant flows at a flow rate corresponding to the heating load required in the conditioned space where the use unit 303 is installed.

The refrigerant that has exited the branch unit 302 enters the heat source unit 301 via the liquid extension pipe 6, and after passing through the outdoor pressure-reducing mechanism 5, the refrigerant enters the outdoor heat exchanger 3. The opening degree of the outdoor pressure-reducing mechanism 5 is being controlled to the full opening. The refrigerant that has entered the outdoor pressure-reducing mechanism 5 is evaporated by exchanging heat with the outside air supplied by the outdoor air-sending device 4, and turns into a low-pressure gas refrigerant. After exiting the outdoor heat exchanger 3, this refrigerant passes through the accumulator 14 via the first four-way valve 2, and is thereafter sucked into the compressor 1 again.

The operating frequency of the compressor 1 is controlled by the control section 103 from a hot water supply request signal detected by the hot water supply tank. Also, the air flow of the outdoor air-sending device 4 is controlled by the control section 103 so that the evaporating temperature becomes a predetermined value in accordance with the outside air temperature detected by the outside air temperature sensor 205. Here, the evaporating temperature is calculated from the temperature detected by the outdoor liquid temperature sensor 204.

[Simultaneous Cooling and Hot Water Supply Operation Mode]

In the simultaneous cooling and hot water supply operation mode, the use unit 303 is in the cooling operation mode, and the hot water supply unit 304 is in the hot water supply operation mode. In the simultaneous cooling and hot water supply operation mode, the first four-way valve 2 is in the state indicated by the broken line, that is, the discharge side of the compressor 1 is connected to the plate water-heat exchanger 16 via the hot water supply gas extension pipe 15, and the suction side of the compressor 1 is connected to the gas side of the outdoor heat exchanger 3. Also, the second four-way valve 13 is in the state indicated by the broken line, that is, the suction side of the compressor 1 is connected to the indoor heat exchanger 9 via the gas extension pipe 12.

In this state of the refrigerant circuit, the compressor 1, when the outdoor air-sending device 4, the indoor air-sending device 10, and the water supply pump 17 are activated, a low-pressure gas refrigerant is sucked into the compressor 1, where the gas refrigerant is compressed into a high-temperature high-pressure gas refrigerant. Thereafter, the high-temperature high-pressure gas refrigerant enters the first four-way valve 2.

The refrigerant that has entered the first four-way valve 2 exits the heat source unit 301, and enters the hot water supply unit 304 via the hot water supply gas extension pipe 15. The refrigerant that has entered the hot water supply unit 304 enters the plate water-heat exchanger 16, where the refrigerant is condensed by exchanging heat with the water supplied by the water supply pump 17 and turns into a high-pressure liquid refrigerant, and exits the plate water-heat exchanger 16. The refrigerant that has heated the water in the plate water-heat exchanger 16 exits the hot water supply unit 304, and enters the branch unit 302 via the hot water supply liquid pipe 18.

The refrigerant that has entered the branch unit 302 is reduced in pressure by the hot water supply pressure-reducing mechanism 19, and turns into a two-phase gas-liquid or liquid-phase refrigerant at intermediate pressure. At this time, the hot water supply pressure-reducing mechanism 19 is controlled to the maximum opening. Thereafter, the refrigerant is divided into a refrigerant that enters the liquid extension pipe 6, and a refrigerant that enters the indoor pressure-reducing mechanism 7.

The refrigerant that has entered the indoor pressure-reducing mechanism 7 is reduced in pressure into a two-phase gas-liquid state at low pressure, and enters the use unit 303 via the indoor liquid pipe 8. The refrigerant that has entered the use unit 303 enters the indoor heat exchanger 9, where the refrigerant is evaporated by exchanging heat with the indoor air supplied by the indoor air-sending device 10 and turns into a low-pressure gas refrigerant.

The indoor pressure-reducing mechanism 7 is controlled by the control section 103 to such an opening degree that the degree of subcooling of the refrigerant on the liquid side of the plate water-heat exchanger 16 becomes a predetermined value. The method of calculating this degree of subcooling is as previously described with reference to the cooling operation mode.

The refrigerant that has flown through the indoor heat exchanger 9 thereafter exits the use unit 303, and enters the heat source unit 301 via the indoor gas pipe 11, the branch unit 302, and the gas extension pipe 12. The refrigerant that has entered the heat source unit 301 passes through the second four-way valve 13, and thereafter joins the refrigerant that has passed through the indoor heat exchanger 3.

Meanwhile, the refrigerant that has entered the liquid extension pipe 6 thereafter enters the heat source unit 301, and after being reduced in pressure into a two-phase gas-liquid refrigerant at low pressure by the heat source-side pressure-reducing mechanism 5, the refrigerant enters the outdoor heat exchanger 3, where the refrigerant is evaporated by exchanging heat with the outdoor air supplied by the outdoor air-sending device 4. Thereafter, the refrigerant passes through the first four-way valve 2, and joins the refrigerant that has passed through the indoor heat exchanger 9. Thereafter, the refrigerant passes through the accumulator 14 and is sucked into the compressor 1 again.

(1) In a case where the simultaneous cooling and hot water supply operation mode is the hot water supply priority mode, the operating frequency of the compressor 1 is controlled by the control section 103 in accordance with a hot water supply request from the hot water supply unit 304. Therefore, in order to make the cooling capacity equal to the cooling load in the use unit 303, heat needs to be removed in the outdoor heat exchanger 3. The opening degree of the outdoor pressure-reducing mechanism 5 is controlled by the control section 103 so that the degree of superheat on the gas side of the outdoor heat exchanger 3 becomes a predetermined value. The degree of superheat on the gas side of the outdoor heat exchanger 3 is calculated by subtracting the temperature detected by the outdoor liquid temperature sensor 204 from the temperature detected by the outdoor gas temperature sensor 203. The air flow of the outdoor air-sending device 4 is controlled by the control section 103 so that in the use unit 303, there is no temperature difference between the indoor set temperature and the temperature detected by the indoor suction temperature sensor 208.

(2) Also, in a case where the simultaneous cooling and hot water supply operation mode is the cooling priority mode, the operating frequency of the compressor 1 is determined by the temperature differential between the indoor suction temperature and the indoor set temperature in accordance with the cooling load in the use unit 303. Thus, there is no need to remove heat in the outdoor heat exchanger 3.

Therefore, the opening degree of the outdoor pressure-reducing mechanism 5 is controlled to a small opening by the control section 103, and the outdoor air-sending device 4 is controlled so as to be stopped by the control section 103.

While hot water can be supplied with higher efficiency by performing the simultaneous cooling and hot water supply operation mode in cooling priority than in hot water supply priority, it takes time for hot water supply to be completed. For this reason, in a case where a large quantity of heat is required until completion of hot water supply, it is necessary to perform the simultaneous cooling and hot water supply operation mode in hot water supply priority in order to prevent running out of hot water. Also, it is considered that in a case where the inlet water temperature is low relative to the set hot water supply temperature, the water temperature in the hot water supply tank 305 is also low, and thus a large quantity of heat is required for hot water supply. Accordingly, it is regarded that the larger the temperature differential between the set hot water supply temperature $T_{wset}$ [° C.] and the inlet water temperature $T_{wi}$ [° C.], the larger the quantity of heat required for hot water supply, and the cooling priority and the hot water supply priority are switched in accordance with the temperature differential $\Delta T_{wm}$ [° C.] (hot water supply temperature differential) between the set hot water supply temperature $T_{wset}$ [° C.] and the inlet water temperature $T_{wi}$ [° C.].

$$T_{wm}=T_{wset}-T_{wi} \tag{1}$$

The set hot water supply temperature $T_{wset}$ refers to the temperature of hot water that is set by the user with a remote control (not illustrated), the temperature of hot water in the hot water supply tank, or the like.

Figure 6:
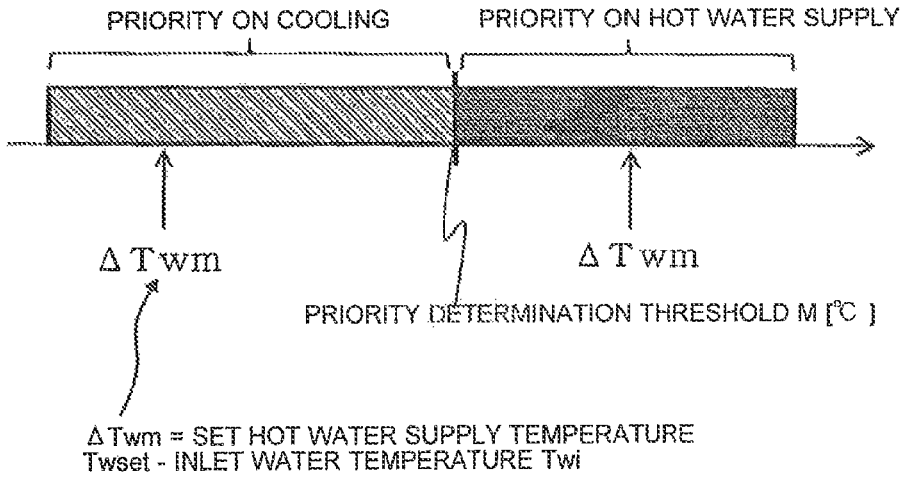
FIG. 6 illustrates switching between the cooling priority mode and the hot water supply priority mode in a cooling waste-heat recovery operation mode according to Embodiment 1.

FIG. 6 illustrates switching between the cooling priority mode and the hot water supply priority mode. The priority operation determination threshold M [° C.] is set as illustrated in FIG. 6. Then, the control section 103 operates in the cooling priority mode when the hot water supply temperature differential $\Delta T_{wm}$ of Equation (1) above is lower than the priority operation determination threshold M [° C.], and operates in hot water supply priority when the hot water supply temperature differential $\Delta T_{wm}$ is equal to or higher than the priority operation determination threshold M [° C.]. Since the hot water supply tank 305 is of an always-full type, the amount of water in the hot water supply tank 305 is always constant. Therefore, in this way, it is possible to appropriately estimate the quantity of heat required for hot water supply. In a case where a large quantity of heat is not required until completion of hot water supply, the operation is performed in cooling priority, and in a case where a large quantity of heat is required, the operation is performed in hot water supply priority to prevent an increase in hot water supply time, thereby preventing running out of hot water.

Figure 7:
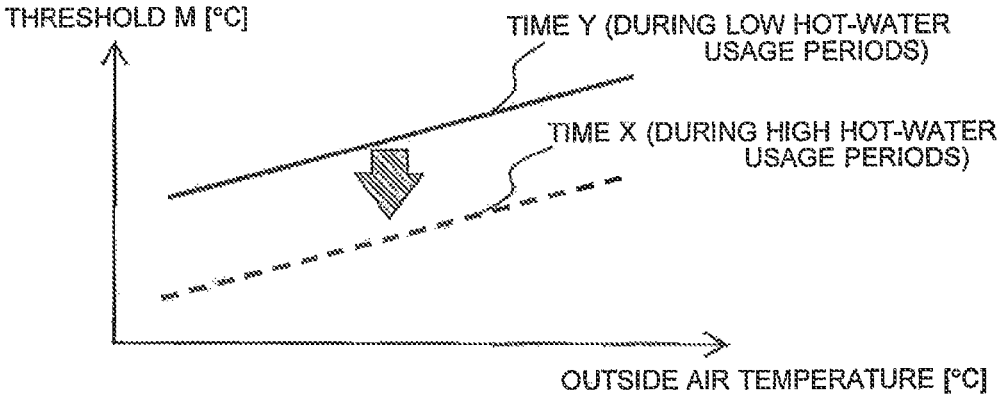
FIG. 7 illustrates the relationship between a priority operation determination threshold M, the outside air temperature, and time according to Embodiment 1.

FIG. 7 illustrates the relationship between the priority operation determination threshold M, the outside air temperature, and time. As illustrated in FIG. 7, as the outside air temperature becomes higher, the amount of hot water usage by the user decreases, and accordingly, the priority operation determination threshold M is set larger. Further, it is preferable to store the amount of hot water usage in a day as a time schedule (variation of amount of daily hot water usage with time) (an example of hot water usage variation data) in the storing section 105 of a microcomputer (system control device 110), and vary the priority operation determination threshold M by the control section 103 in accordance with the time schedule of the amount of hot water usage on the basis of the time measurement by the clock section 104. Specifically, as illustrated in FIG. 7, the control section 103 sets the priority operation determination threshold M smaller at a time (time X) during high hot water usage periods in a day than at a time (time Y) during low hot water usage periods. Alternatively, the control section 103 sets the priority operation determination threshold M smaller during a time period in the time schedule in which the amount of hot water usage exceeds a predetermined amount than during a time period in which the amount of hot water usage does not exceed the predetermined amount. Through this control, more specific information is inputted with respect to the amount of hot water usage by the user, thereby preventing running out of hot water.

The time schedule of daily hot water usage is prepared by recording the amount of hot water usage into a memory within the microcomputer at intervals of every hour or more (e.g. every two hours) over a day or more days (e.g. one week), Also, the time schedule may be inputted by the user.

Figure 8:
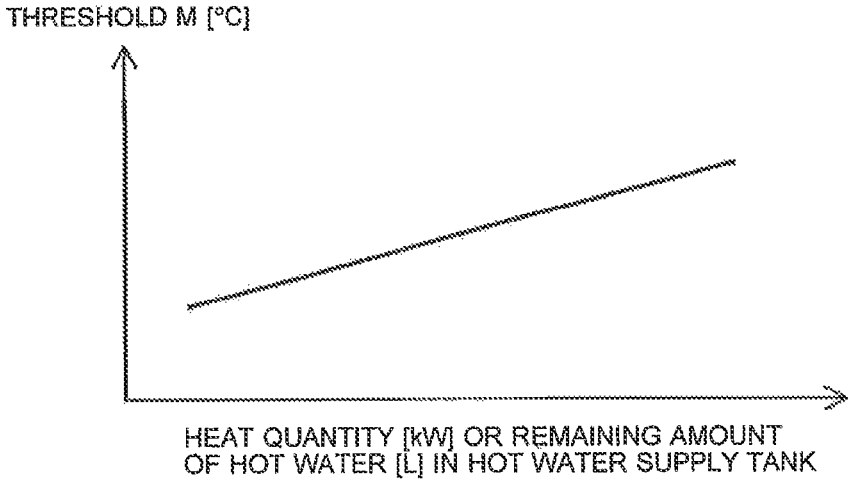
FIG. 8 illustrates the relationship between the priority operation determination threshold M, and the quantity of heat or the remaining amount of hot water in a hot water supply tank according to Embodiment 1.

FIG. 8 illustrates the relationship between the priority operation determination threshold M, and the quantity of heat or the remaining amount of hot water in the hot water supply tank. As illustrated in FIG. 8, the larger the quantity of heat stored or the remaining amount of hot water in the hot water supply tank 305, the larger the priority operation determination threshold M [° C.] is set. Specifically, the control section 103 receives input of a stored heat quantity stored in the hot water supply tank 305 from the computing section 102 (stored heat quantity computing section) that computes the stored heat quantity. Then, as illustrated in FIG. 8, the larger the inputted stored heat quantity, the larger the control section 103 sets the priority operation determination threshold M. As for the remaining amount of hot water, as illustrated in FIG. 8, the control section 103 receives input of a stored heat quantity stored in the hot water supply tank 305 from the computing section 102 (stored heat quantity computing section) that computes the stored heat quantity, and as illustrated in FIG. 8, the larger the inputted stored heat quantity, the larger the control section 103 sets the priority operation determination threshold M. This control makes it possible to prevent the hot water supply priority operation from being executed even through a large quantity of effective heat exists in the hot water supply tank, and eliminate loss of opportunities for executing the cooling priority operation mode, thereby achieving higher operation efficiency. The specific method of computing, by the computing section 102, the quantity of heat and remaining amount of hot water in the hot water supply tank 305 is as described below.

The computing section 102 computes the heat quantity $Q_{TANK}$ [KJ] in the hot water supply tank from Equation (2) below, by using the temperature sensors provided to the hot water supply tank 305 according to Embodiment 1:

[Formula 1]

$$\begin{aligned} Q_{TANK} = \frac{\rho_w \times C_{p,w}}{1000} \times [&V_{TANK,1} \times (T_{TANK,1} - T_{TANKwi}) + \\ &(T_{TANK,2} - T_{TANK,1}) \times (T_{TANK,2} - T_{TANKwi}) + \\ &(T_{TANK,3} - T_{TANK,2}) \times (T_{TANK,3} - T_{TANKwi}) + \\ &(T_{TANK,4} - T_{TANK,3}) \times (T_{TANK,4} - T_{TANKwi})] \end{aligned} \tag{2}$$

where $\rho_w$ [g/m3] denotes the density of water, $C_{p,w}$ [kJ/kgK] denotes the specific heat of water, $V_{TANK,1}$ [L] denotes the internal volume of the hot water supply tank from the top of the hot water supply tank 305 to the installation height of the first hot water supply tank water temperature sensor 212, $V_{TANK,2}$ [L] denotes the internal volume of the hot water supply tank from the top of the hot water supply tank 305 to the installation height of the second hot water supply tank water temperature sensor 213, $V_{TANK,\ 3}$ [L] denotes the internal volume of the hot water supply tank from the top of the hot water supply tank 305 to the installation height of the third hot water supply tank water temperature sensor 214, and $V_{TANK,\ 4}$ [L] denotes the internal volume of the hot water supply tank from the top of the hot water supply tank 305 to the installation height of the fourth hot water supply tank water temperature sensor 215.

Since the cross-sectional area of the hot water supply tank is already known from the device specifications, the internal volumes can be computed by determining the installation heights of the respective sensors in advance at the time of design.

$T_{TANK,\ 1}$ [° C.] denotes the detection temperature of the first hot water supply tank water temperature sensor 212, $T_{TANK,\ 2}$ [° C.] denotes the detection temperature of the second hot water supply tank water temperature sensor 213, $T_{TANK,\ 3}$ [° C.] denotes the detection temperature of the third hot water supply tank water temperature sensor 214, and $T_{TANK,\ 4}$ [° C.] denotes the detection temperature of the fourth hot water supply tank water temperature sensor 215.

Also, $T_{TANKWi}$ [° C.] denotes the detection temperature of the water supply temperature sensor 216.

In this way, it is possible to compute the stored heat quantity stored in the hot water supply tank 305.

For example, the computing section 102 computes the heat quantity $Q_{TANK}$ in the hot water supply tank 305 by setting $T_{TANK,\ 1}$, $T_{TANK,\ 2}$, $T_{TANK,\ 3}$, $T_{TANK,\ 4}$ to $T_{w,\ set}$, by regarding that the temperature of hot water in the hot water supply tank 305 has reached the hot water supply temperature $T_{w,\ set}$. Then, in a case where the value of $Q_{TANK}$ computed from sensor information on the current temperature of the hot water supply tank 305 is equal to or less than half (predetermined heat quantity) of this computed value, the control section 103 sets the operation to the hot water supply priority operation mode irrespective of the hot water supply temperature differential $\Delta T_{wm}$. Specifically, while executing a simultaneous operation of the cooling operation and the hot water supply operation, the control section 103 receives input of a stored heat quantity stored in the hot water supply tank 305 from the computing section 102 (stored heat quantity computing section) that computes the stored heat quantity. The control section 103 executes the hot water supply priority mode when the stored heat quantity inputted from the computing section 102 is smaller than a predetermined heat quantity. This control prevents running out of hot water. While four temperature sensors are installed on the side surface of the tank in the hot water supply tank according to Embodiment 1, the number of temperature sensors is not limited to this. It is possible to compute the heat quantity in the hot water supply tank 305 with higher precision by installing more temperature sensors in the height direction of the tank.

By using the heat quantity $Q_{TANK}$ in the hot water supply tank 305, the computing section 102 can compute the remaining amount of hot water $L_w$ [L] as follows.

[Formula 2]

$$L_w = \frac{1000 \times Q_{TANK}}{\rho_w \times C_{p,w} \times (T_{wu} - T_{TANKwi})} \tag{3}$$

where $T_{wu}$ denotes the temperature [° C.] hot water used by the user. Also, for example, when the remaining amount of hot water $L_w$ [L] becomes equal to or less than half of the capacity (predetermined capacity) of the hot water supply tank 305, the operation is set to the hot water supply priority operation mode irrespective of the hot water supply temperature differential $\Delta T_{wm}$. That is, while executing a simultaneous operation of the cooling operation and the hot water supply operation, the control section 103 receives input of the remaining amount of hot water $L_w$ remaining in the hot water supply tank 305 from the computing section (remaining hot water amount computing section) that computes the remaining amount of hot water, and executes the hot water supply priority mode when the inputted remaining amount of hot water $L_w$ is less than a predetermined amount. This control prevents running out of hot water.

Also, in a case where the simultaneous cooling and hot water supply operation mode is executed in the cooling priority mode, and the cooling load in the use unit 303 is small, the operating frequency of the compressor 1 is controlled lower, and thus it takes time for hot water supply to be completed even if the priority operation determination threshold M is small. Therefore, the control section 103 measures the operating time of the cooling priority mode by the clock section 104, and makes the operating frequency of the compressor 1 higher to thereby increase the hot water supply capacity when the operating time of the cooling priority mode becomes equal to or more than a predetermined time. At this time, the larger the hot water supply temperature differential $\Delta T_{wm}$, the higher the operating frequency of the compressor 1 is controlled. That is, while executing a simultaneous operation of the cooling operation and the hot water supply operation, when the execution time of the cooling priority mode becomes equal to or more than a predetermined time, the larger the temperature differential $T_{wm}$, the higher the control section 103 controls the operating frequency of the compressor 1. Through this control, hot water can be supplied with higher efficiency than when the operation is executed in hot water supply priority, and the hot water supply time can be shortened, thereby preventing running out of hot water. Also, the operation may be forcibly set to the hot water supply priority mode.

When the cooling load is high, the operating frequency of the compressor 1 is controlled higher. Therefore, the superiority of the cooling priority mode to the hot water supply priority mode in terms of the coefficient of performance becomes smaller. In this case, the operation may be executed in the hot water supply priority mode to give priority to shortening of the hot water supply time. Specifically, since the quantity of heat removed in the outdoor heat exchanger 3 is 0, the coefficient of performance (COP) [-] of the cooling priority mode in cooling waste-heat recovery operation can be computed by the equation below from the sum of the cooling capacity of the use unit 303 and the hot water supply capacity of the hot water supply unit 304 with respect to the amount of input to the compressor 1.

[Formula 3]

$$COP = \frac{Q_w + (Q_w - W_{comp})}{W_{comp}} \tag{4}$$

where $Q_w$ denotes the hot water supply capacity [kW], and $W_{COMP}$ denotes the compressor input "kW". The second term of the numerator is the cooling capacity, which is the difference between the hot water supply capacity $Q_w$ and the compressor input $W_{COMP}$. $W_{COMP}$ is computed by the equation below from the operational state of the refrigeration cycle:

$$W_{COMP}=G_r\times(h_d-h_s) \quad (5)$$

where $G_r$ [kg/s] denotes the circulation amount of refrigerant at the discharge of the compressor, and is determined from the saturation temperature (condensing temperature) of the pressure detected by the high-pressure pressure sensor 201, the temperature (evaporating temperature) detected by the indoor liquid temperature sensor 206, and the compressor frequency.

$h_d$ [kJ/kg] denotes the specific enthalpy at the discharge of the compressor, and is computed from the pressure detected by the high-pressure pressure sensor 201, and the temperature detected by the discharge temperature sensor 202.

$h_s$ [kJ/kg] denotes the specific enthalpy at the suction of the compressor, and since the circuit is an accumulator circuit, the degree of suction superheating is 0, and the specific enthalpy is computed from the indoor liquid temperature sensor 206.

Also, Qw is computed by the equation below from the difference between the outlet and inlet temperatures of water supplied to the hot water supply unit 304:

$$Q_w=\rho_w\times C_{p,w}\times V_w\times(T_{wo}-T_{wi}) \quad (6)$$

where $\rho_w$ [kg/m3] denotes the density of water, $C_{p,w}$ [kJ/(kg° C.)] denotes the specific heat of water, $V_w$ [m3/s] denotes the flow rate of water, $T_{wo}$ [° C.] denotes the water temperature at the outlet of the plate water-heat exchanger 16, and $T_{wi}$ denotes the water temperature at the inlet of the plate water-heat exchanger 16.

Through the above process, the control section 103 can compute the coefficient of performance (COP) from the operational state. The control section 103 forcibly sets the operation to the hot water supply priority mode when COP becomes equal to or less than a predetermined value.

In this way, while executing the cooling priority mode, the control section 103 receives input of the coefficient of performance (COP) of the cooling priority mode from the computing section (coefficient-of-performance computing section) that computes the coefficient of performance (COP) of the cooling priority mode, and when the inputted coefficient of performance (COP) is equal to or less than a predetermined value, the control section 103 switches the cooling priority mode that is being executed to the hot water supply priority mode.

Also, the use unit 303 or a remote control for operating the use unit 303 may be provided with a display section that allows the operation of the combined air-conditioning and hot water supply system 100 or the heat source unit 301 to be recognized, so that the user can change the operation of the heat source unit 301.

For example, during the simultaneous cooling and hot water supply operation mode, an indication of the cooling priority mode or hot water supply priority mode is displayed on the display section. Then, when the user recognizes an abrupt increase in the consumption of hot water, the hot water supply priority mode is forcibly designated with the remote control (operating section), thereby preventing running out of hot water.

Alternatively, it is also preferable to display an indication of the cooling operation mode, the simultaneous heating and hot water supply operation mode, the simultaneous cooling and hot water supply operation mode, or the like so that the user can easily recognize the operational state.

That is, as illustrated in FIG. 1, the use unit 303 includes a display section 303-1 and an operating section 303-2. The display section 303-1 displays whether the current operation mode is the cooling priority mode or the hot water supply priority mode. When a predetermined operation is made on the operating section 303-2, the operating section 303-2 outputs a switch command signal that commands switching from the current priority mode displayed on the display section 303-1 to the other priority mode. Then, the switch command signal outputted from the operating section 303-2 is inputted, and upon receiving input of the switch command signal, the control section 103 switches the current priority mode to the other priority mode. In the case of using a remote control, a switch command signal is outputted from a remote control that has a display section for displaying whether the current operation mode is the cooling priority mode or the hot water supply priority mode, and outputs the switch command signal that commands switching from the current priority mode displayed on the display section to the other priority mode. Upon receiving input of the switch command signal, the control section 103 switches the current priority mode to the other priority mode.

When the flow rate of water in the plate heat-water exchanger 16 is constant, the condensing temperature CT [° C.] of the outdoor heat exchanger 3 varies with the detection temperature of the inlet water temperature sensor 210. Therefore, ΔT in Equation 7 below calculated by the temperature differential between the condensing temperature CT [° C.] of the outdoor heat exchanger 3 and the set hot water supply temperature $T_{wset}$ [° C.] may be used instead of the temperature differential $\Delta T_{wm}$ [° C.]. In this way, even if there is no inlet water temperature sensor 210, ΔT in Equation 7 can be used to determine whether the operation is to be the cooling priority operation or the hot water supply priority operation on the basis of the priority operation determination threshold M.

In this way, while executing a simultaneous operation of the cooling operation and the hot water supply operation, the control section 103 receives input of the condensing temperature CT of the outdoor heat exchanger 3 from the computing section 102 (condensing temperature computing section) that computes the condensing temperature CT. Then, instead of the hot water supply temperature differential $\Delta T_{wm}$, the control section 103 uses the temperature differential ΔT (Equation 7 below) between the set hot water supply temperature $T_{wset}$ and the condensing temperature CT.

$$\Delta T=T_{wset}-CT \quad (7)$$

According to Embodiment 1 described above, it is possible to provide the combined air-conditioning and hot water supply system 100 capable of recovering waste heat generated in cooling to the hot water supply operation, which is highly efficient and does not compromise indoor comfort, and does not require a long time for hot water supply to be completed, thereby preventing running out of hot water.

Embodiment 2

Hereinafter, Embodiment 2 will be described with reference to FIGS. 9 to 12.

Figure 9:
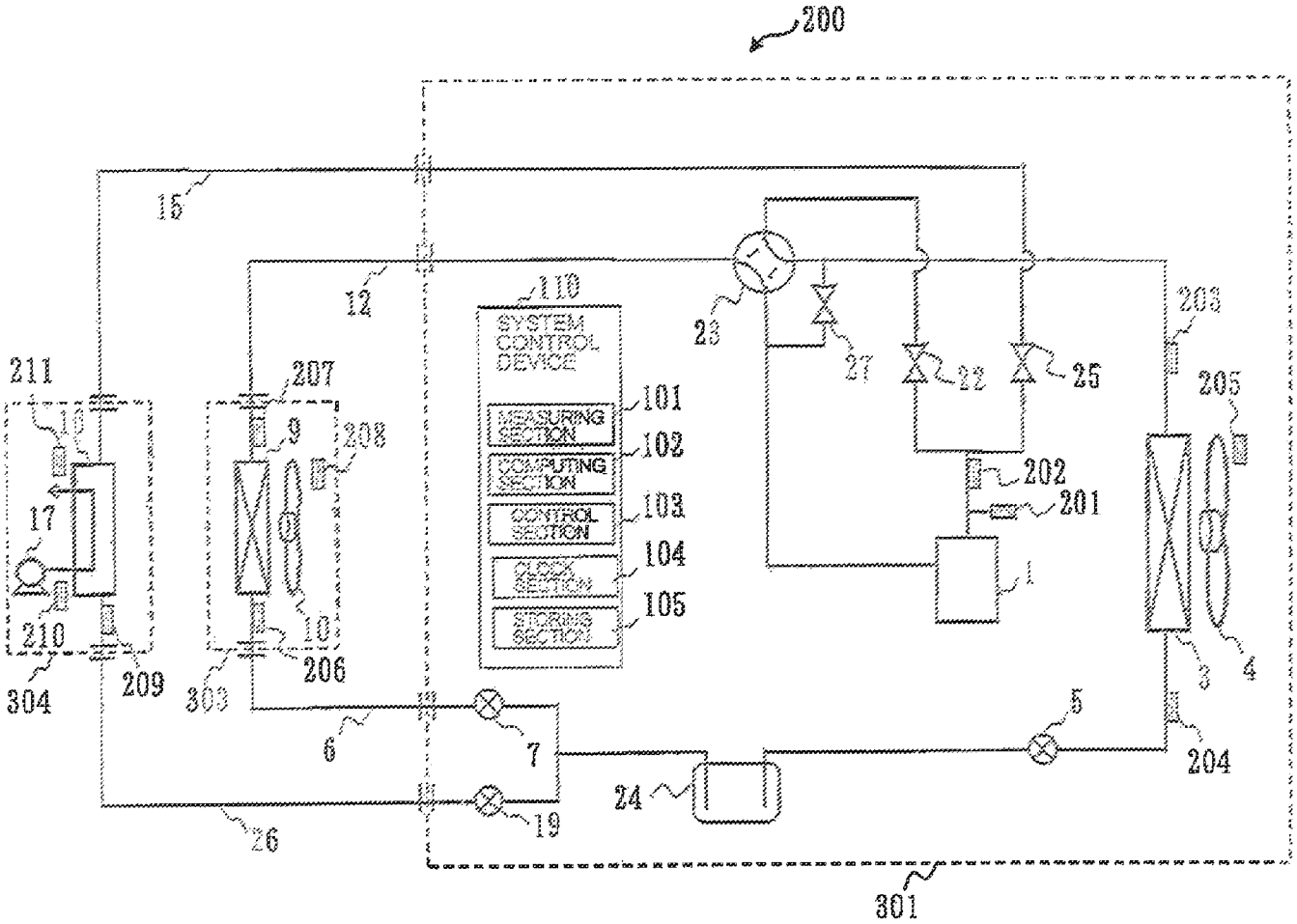
FIG. 9 is a refrigerant circuit diagram of a combined air-conditioning and hot water supply system 200 according to Embodiment 2.

FIG. 9 is a refrigerant circuit diagram illustrating the refrigerant circuit configuration of a combined air-conditioning and hot water supply system 200 according to Embodiment 2. The configuration and operation of the combined air-conditioning and hot water supply system 200 will be described with reference to FIG. 9. The combined air-conditioning and hot water supply system 200 according to Embodiment 2 also includes the system control device 110. The following description of Embodiment 2 mainly focuses on differences from Embodiment 1 described above, and portions having the same functions as those in Embodiment 1 are denoted by the same reference numerals and a description of those portions is omitted.

The combined air-conditioning and hot water supply system 200 is a three-pipe multisystem combined air-conditioning and hot water supply system that can simultaneously handle a selected cooling operation or heating operation in the use unit 303 and a hot water supply operation in the hot water supply unit, by carrying out a vapor compression refrigeration cycle operation. The combined air-conditioning and hot water supply system 200 executes the hot water supply operation in the hot water supply unit when the cooling operation is being performed, thereby enabling recovery of waste heat generated in the cooling operation. Thus, the combined air-conditioning and hot water supply system 200 is highly efficient and does not compromise indoor comfort, and can prevent running out of hot water by ensuring that it does not take a long time to complete hot water supply.

<Device Configuration>

The combined air-conditioning and hot water supply system 200 includes the heat source unit 301, the use unit 303, the hot water supply unit 304, and the hot water supply tank 305. Since the combined air-conditioning and hot water supply system 200 according to Embodiment 2 is provided with a single use unit, with regard to the representation of the components related to the use unit 303, alphabets following the corresponding numerals are not indicated. The heat source unit 301 and the use unit 303 are connected via the liquid extension pipe 6 that is a refrigerant pipe, and the gas extension pipe 12 that is a refrigerant pipe. The heat source unit 301 and the hot water supply unit 304 are connected by the hot water supply gas extension pipe 15 that is a refrigerant pipe, and a hot water supply liquid extension pipe 26 that is a refrigerant pipe. The hot water supply unit 304 and the hot water supply tank 305 are connected by the upstream water pipe 20 that is a water pipe, and the downstream water pipe 21 that is a water pipe.

<Heat Source Unit 301>

The configuration of the refrigerant circuit of each of the use unit 303 and the hot water supply unit 304 is the same as that of the combined air-conditioning and hot water supply system 100 according to Embodiment 1. Also, the configuration of the water circuit of the hot water supply tank 305 is the same as that of the combined air-conditioning and hot water supply system 100 according to Embodiment 1. The circuit configuration of the heat source unit 301 is such that the first four-way valve 2, the second four-way valve 13, and the accumulator 14 are removed from the combined air-conditioning and hot water supply system 100 according to Embodiment 1, and an air-conditioning discharge solenoid valve 22 that controls the direction of flow of refrigerant, a hot water supply discharge solenoid valve 25, a low-pressure equalizing solenoid valve 27, a third three-way valve 23 that switches the direction of flow of refrigerant, and a receiver 24 for storing excess refrigerant are installed. That is, as its constituent devices, the outdoor-side refrigerant circuit provided in the heat source unit 301 has the compressor 1, the third four-way valve 23, the outdoor heat exchanger 3, the outdoor air-sending device 4, the outdoor pressure-reducing mechanism 5, the receiver 24, the air-conditioning discharge solenoid valve 22, the hot water supply discharge solenoid valve 25, and the low-pressure equalizing solenoid valve 27.

<Operation Modes>

Like the combined air-conditioning and hot water supply system 100 according to Embodiment 1, the combined air-conditioning and hot water supply system 200 can execute three operation modes (a cooling operation mode, a simultaneous heating and hot water supply operation mode, and a simultaneous cooling and hot water supply operation mode).

FIG. 10 illustrates details of operations of the four-way valve 23 and the like with respect to the operation modes of the heat source unit 301 of the combined air-conditioning and hot water supply system 200. The operations of the four-way valve and solenoid valves in individual operation modes are as illustrated in FIG. 10. Also, like the combined air-conditioning and hot water supply system 100 according to Embodiment 1, the cooling and hot water supply operation mode includes a hot water supply priority mode that determines the operating frequency of the compressor 1 in accordance with a hot water supply request from the hot water supply unit 304, and a cooling priority mode that determines the operating frequency of the compressor 1 in accordance with the cooling load in the use unit 303.

[Cooling Operation Mode]

In the cooling operation mode, the third four-way valve 23 is in the state indicated by the solid line, that is, a state in which the discharge side of the compressor 1 is connected to the gas side of the outdoor heat exchanger 3, and the suction side of the compressor 1 is connected to the gas side of the indoor heat exchanger 9. Also, the air-conditioning discharge solenoid valve 22 is open, the hot water supply discharge solenoid valve 25 is closed, and the low-pressure equalizing solenoid valve 27 is closed. In this state of the refrigerant circuit, the control section 103 activates the compressor 1, the outdoor air-sending device 4, and the indoor air-sending device 10. Then, a low-pressure gas refrigerant is sucked into the compressor 1, where the gas refrigerant is compressed into a high-temperature high-pressure gas refrigerant. Thereafter, the high-temperature high-pressure gas refrigerant enters the outdoor heat exchanger 3 via the third four-way valve 23, where the gas refrigerant is condensed by exchanging heat with the outdoor air supplied by the outdoor air-sending device 4, and turns into a low-pressure gas refrigerant.

After exiting the outdoor heat exchanger 3, the refrigerant flows to the outdoor pressure-reducing mechanism 5, where the refrigerant is reduced in pressure. The outdoor pressure-reducing mechanism 5 is controlled so that the degree of subcooling on the liquid side of the outdoor heat exchanger 3 becomes a predetermined value. The degree of subcooling on the liquid side of the outdoor heat exchanger 3 is calculated by subtracting the temperature detected by the outdoor liquid temperature sensor 204, from the saturation temperature computed from the pressure detected by the high-pressure pressure sensor 201.

After exiting the outdoor pressure-reducing mechanism 5, the refrigerant passes through the receiver 24, is reduced in pressure in the indoor pressure-reducing mechanism 7, and exits the heat source unit 301. Then, the refrigerant enters the use unit 303 via the liquid extension pipe 6, and enters the indoor heat exchanger 9, where the refrigerant is evaporated by exchanging heat with the indoor air supplied from the indoor air-sending device 10, and turns into a low-pressure gas refrigerant. The indoor pressure-reducing mechanism 7 is controlled so that the degree of superheat on the gas side of the indoor heat exchanger 9 becomes a predetermined value. The degree of superheat on the gas side of the indoor heat exchanger 9 is calculated by subtracting the temperature detected by the indoor liquid temperature sensor 206, from the temperature detected by the indoor gas temperature sensor 207. After exiting the indoor heat exchanger 9, the refrigerant exits the use unit 303, and enters the heat source unit 301 via the gas extension pipe 12. Thereafter, the refrigerant passes through the third three-way valve 23, and enters the compressor 1 again.

The operating frequency of the compressor 1 is controlled by the control section 103 so that in the use unit 303, the temperature difference between the indoor set temperature and the temperature detected by the indoor suction temperature sensor 208 becomes small. Also, the air flow of the outdoor air-sending device 4 is controlled by the control section 103 so that the condensing temperature becomes a predetermined value in accordance with the outside air temperature detected by the outside air temperature sensor 205. Here, the condensing temperature is the saturation temperature computed from the pressure detected by the high-pressure pressure sensor 201.

[Simultaneous Heating and Hot Water Supply Operation Mode]

In the simultaneous heating and hot water supply operation mode, the third four-way valve 23 is in the state indicated by the broken line, that is, the discharge side of the compressor 1 is connected to the gas side of the indoor heat exchanger 9, and the suction side of the compressor 1 is connected to the gas side of the outdoor heat exchanger 3. Also, the air-conditioning discharge solenoid valve 22 is open, the hot water supply discharge solenoid valve 25 is open, and the low-pressure equalizing solenoid valve 27 is closed. In this state of the refrigerant circuit, the compressor 1, the outdoor air-sending device 4, the indoor air-sending device 10, and the water supply pump 17 are activated. Then, a low-pressure gas refrigerant is sucked into the compressor 1, where the refrigerant is compressed into a high-temperature high-pressure gas refrigerant. Thereafter, the high-temperature high-pressure gas refrigerant is distributed so as to flow through the hot water supply discharge solenoid valve 25 or the air-conditioning discharge solenoid valve 22.

The refrigerant that has entered the hot water supply discharge solenoid valve 25 exits the heat source unit 301, and enters the hot water supply unit 304 via the hot water supply gas extension pipe 15. The refrigerant that has entered the hot water supply unit 304 enters the plate water-heat exchanger 16, where the refrigerant is condensed by exchanging heat with the water supplied by the water supply pump 17 and turns into a high-pressure liquid refrigerant, and exits the plate water-heat exchanger 16. After the refrigerant that has heated the water in the plate water-heat exchanger 16 exits the hot water supply unit 304, the refrigerant enters the heat source unit 301 via the hot water supply liquid extension pipe 26, and is reduced in pressure by the hot water supply pressure-reducing mechanism 19. Thereafter, the refrigerant joins the refrigerant that has flown through the indoor pressure-reducing mechanism 7. The hot water supply pressure-reducing mechanism 19 is controlled by the control section 103 to such an opening degree that the degree of subcooling on the liquid side of the plate water-heat exchanger 16 becomes a predetermined value. The degree of subcooling on the liquid side of the plate water-heat exchanger 16 is calculated by computing the saturation temperature (condensing temperature) from the pressure detected by the high-pressure pressure sensor 201, and subtracting the temperature detected by the hot water supply liquid temperature sensor 209 from the saturation temperature.

Meanwhile, after the refrigerant that has entered the air-conditioning discharge solenoid valve 22 passes through the third four-way valve 23, the refrigerant exists the heat source unit 301, and enters the use unit 303 via the gas extension pipe 12. The refrigerant that has entered the use unit 303 enters the indoor heat exchanger 9, where the refrigerant is condensed by exchanging heat with the indoor air supplied by the indoor air-sending device 10 and turns into a high-pressure liquid refrigerant, and exits the indoor heat exchanger 9. The refrigerant that has heated the indoor air in the indoor heat exchanger 9 exits the use unit 303, enters the heat source unit 301 via the liquid extension pipe 6, and is reduced in pressure by the indoor pressure-reducing mechanism 7. Thereafter, the refrigerant joins the refrigerant that has flown through the hot water supply pressure-reducing mechanism 19. Here, the indoor pressure-reducing mechanism 7 is controlled by the control section 103 to such an opening degree that the degree of subcooling of the refrigerant on the liquid side of the indoor heat exchanger 9 becomes a predetermined value. The degree of subcooling of the refrigerant on the liquid side of the indoor heat exchanger 9 is calculated by subtracting the temperature detected by the indoor liquid temperature sensor 206, from the saturation temperature (condensing temperature) computed from the pressure detected by the high-pressure pressure sensor 201.

Thereafter, the joined refrigerant passes through the receiver 24, is reduced in pressure by the outdoor pressure-reducing mechanism 5, and enters the outdoor heat exchanger 2. The opening degree of the outdoor pressure-reducing mechanism 5 is controlled so that the degree of superheat on the gas side of the outdoor heat exchanger 3 becomes a predetermined value. The degree of superheat on the gas side of the outdoor heat exchanger 3 is calculated by subtracting the temperature detected by the outdoor liquid temperature sensor 204 from the temperature detected by the outdoor gas temperature sensor 203. The refrigerant that has entered the outdoor heat exchanger 3 is evaporated by exchanging heat with the indoor air supplied by the outdoor air-sending device 4 and turns into a low-pressure gas refrigerant. After exiting the outdoor heat exchanger 3, this refrigerant is sucked into the compressor 1 again via the third four-way valve 23.

The operating frequency of the compressor 1 is controlled by the control section 103 from a hot water supply request signal detected by the hot water supply tank. Also, the air flow of the outdoor air-sending device 4 is controlled by the control section 103 so that the evaporating temperature becomes a predetermined value in accordance with the outside air temperature detected by the outside air temperature sensor 205. Here, the evaporating temperature is calculated from the temperature detected by the outdoor liquid temperature sensor 204.

[Simultaneous Cooling and Hot Water Supply Operation Mode]

In the simultaneous cooling and hot water supply operation mode, the third four-way valve 23 is in the state indicated by the solid line, that is, the discharge side of the compressor 1 is connected to the gas side of the outdoor heat exchanger 3, and the suction side of the compressor 1 is connected to the gas side of the indoor heat exchanger 9. Also, the air-conditioning discharge solenoid valve 22 is closed, the hot water supply discharge solenoid valve 25 is open, and the low-pressure equalizing solenoid valve 27 is open. In this state of the refrigerant circuit, when the compressor 1, the outdoor air-sending device 4, the indoor air-sending device 10, and the water supply pump 17 are activated, a low-pressure gas refrigerant is sucked into the compressor 1, where the refrigerant is compressed into a high-temperature high-pressure gas refrigerant. Thereafter, the high-temperature high-pressure gas refrigerant passes through the hot water supply discharge solenoid valve 25 and exits the heat source unit 301, and enters the hot water supply unit 304 via the hot water supply gas extension pipe 15. The refrigerant that has entered the hot water supply unit 304 enters the plate water-heat exchanger 16, where the refrigerant is condensed by exchanging heat with the water supplied by the water supply pump 17 and turns into a high-pressure liquid refrigerant, and exits the plate water-heat exchanger 16. The refrigerant that has heated the water in the plate water-heat exchanger 16 exits the hot water supply unit 304, and enters the heat source unit 301 via the hot water supply liquid extension pipe 26.

The refrigerant that has entered the heat source unit 301 passes through the hot water supply pressure-reducing mechanism 19 that is fixed to the maximum opening, and thereafter, the refrigerant is divided into a refrigerant that enters the indoor pressure-reducing mechanism 7, and a refrigerant that enters the receiver 24. The refrigerant that has entered the indoor pressure-reducing mechanism 7 is reduced in pressure. Thereafter, the refrigerant exits the heat source unit 301, and enters the use unit 303 via the liquid extension pipe 6. The refrigerant then enters the indoor heat exchanger 9, where the refrigerant is evaporated by exchanging heat with the indoor air supplied by the indoor air-sending device 10 and turns into a low-pressure gas refrigerant. Here, the indoor pressure-reducing mechanism 7 is controlled so that the degree of superheat on the gas side of the indoor heat exchanger 9 becomes a predetermined value. The method of calculating this degree of superheat is the same as in the case of the cooling operation mode.

The refrigerant that has flown through the indoor heat exchanger 9 thereafter exits the use unit 303, and enters the heat source unit 301 via the gas extension pipe 12. The refrigerant that has entered the heat source unit 301 passes through the third four-way valve 23, and thereafter joins the refrigerant that has passed through the indoor heat exchanger 3.

Meanwhile, the refrigerant that has entered the receiver 24 passes through the outdoor pressure-reducing mechanism 5 that is fixed to a small opening, where the pressure of the refrigerant is reduced to a low pressure. Thereafter, the refrigerant is heated by the outside air in the outdoor heat exchanger 3, and turns into a low-pressure gas refrigerant. Thereafter, the refrigerant passes through the low-pressure equalizing solenoid valve 27, and joins the refrigerant that has passed through the indoor heat exchanger 9. After joining, the resulting refrigerant is sucked into the compressor 1 again.

Since the low-pressure equalizing solenoid valve 27 is installed in order to make the pressure in the outdoor heat exchanger 3 low, its bore diameter is small. Therefore, the low-pressure equalizing solenoid valve 27 is unable to remove excess heat of cooling. Therefore, the air flow of the outdoor air-sending device 4 is controlled to the minimum value required to cool the radiator plate, and the opening degree of the outdoor pressure-reducing mechanism 5 is controlled to a small opening.

In a case where the simultaneous cooling and hot water supply operation mode is the hot water supply priority mode, the operating frequency of the compressor 1 is controlled by the control section 103 on the basis of a hot water supply request from the hot water supply unit 304. Also, in a case where the simultaneous cooling and hot water supply operation mode is the cooling priority mode, the operating frequency of the compressor 1 is determined from the temperature differential between the indoor suction temperature and the indoor set temperature in accordance with the cooling load in the use unit 303.

In the case of the combined air-conditioning and hot water supply system 200 according to Embodiment 2, in the simultaneous cooling and hot water supply operation mode, the small bore diameter of the low-pressure equalizing valve 27 makes it impossible to make a large amount of refrigerant flow to the outdoor heat exchanger 3. Consequently, heat cannot be removed in the outdoor heat exchanger 3, which means that waste heat generated in cooling is completely recovered for the hot water supply. Therefore, the operation according to the hot water supply priority mode differs from that in the case of the combined air-conditioning and hot water supply system 100 according to Embodiment 1.

FIG. 11 is a schematic diagram of operations of the hot water supply priority mode and cooling priority mode in the simultaneous cooling and hot water supply operation of the combined air-cooling and hot water supply system 100 according to Embodiment 2. The hatching in FIG. 11 indicates a cooling capacity 602. In a case where the simultaneous cooling and hot water supply operation mode is executed in the hot water supply priority mode, the operating frequency of the compressor 1 is determined in accordance with a hot water supply request signal from the hot water supply unit 304, and thus the cooling capacity becomes larger than the cooling load. Therefore, when the cooling indoor temperature of the use unit 303 becomes lower than the indoor set temperature, the control section 103 turns the cooling thermo OFF, and executes the hot water supply operation. In cooling thermo OFF, for example, the control section 103 executes a control that sets the operation to hot water supply operation by closing the indoor pressure-reducing mechanism 7, and by closing the low-pressure equalizing solenoid valve 27 and switching the four-way valve 23 to the state of the broken line. Here, switching of the four-way valve 23 requires the presence of a differential pressure between upstream and downstream of the four-way valve 23. In the simultaneous cooling and hot water supply operation, the pressure is low both upstream and downstream of the four-way valve 23. Accordingly, the four-way valve 23 is switched after carrying out a control for securing a differential pressure. That is, after closing the low-pressure equalizing solenoid valve 27, the air-conditioning discharge solenoid valve 22 is kept open for a predetermined time, and after the pressure on the gas side of the outdoor heat exchanger 3 rises and a differential pressure between upstream and downstream of the four-way valve 23 is secured, the four-way valve 23 is switched by closing the air-conditioning discharge solenoid valve 22 again. Also, when the cooling indoor temperature (suction air temperature) of the use unit 303 becomes higher than the indoor set temperature (cooling set temperature), the simultaneous cooling and hot water supply operation is executed in the hot water supply mode again. That is, the indoor pressure-reducing mechanism 7 is opened, the four-way valve 23 is switched to the state of the broken line, and the low-pressure equalizing solenoid valve 23 is controlled to be open. When there is no longer hot water supply request from the hot water supply unit 304 and hot water supply is complete, the cooling operation is performed. In this operation, the operating frequency of the compressor 1 is raised to increase the hot water supply capacity, thereby completing hot water supply in a short time.

In this way, while executing a simultaneous operation of the cooling operation and the hot water supply operation, when the suction air temperature of the use unit 303 becomes higher than the indoor set temperature, the control section 103 stops the cooling operation of the use unit 303 until the suction air temperature of the use unit 303 becomes higher than the indoor set temperature.

While the current indoor suction temperature is used in this case to determine cooling thermo OFF, a value computed after a predetermined time may be used.

Figure 12:
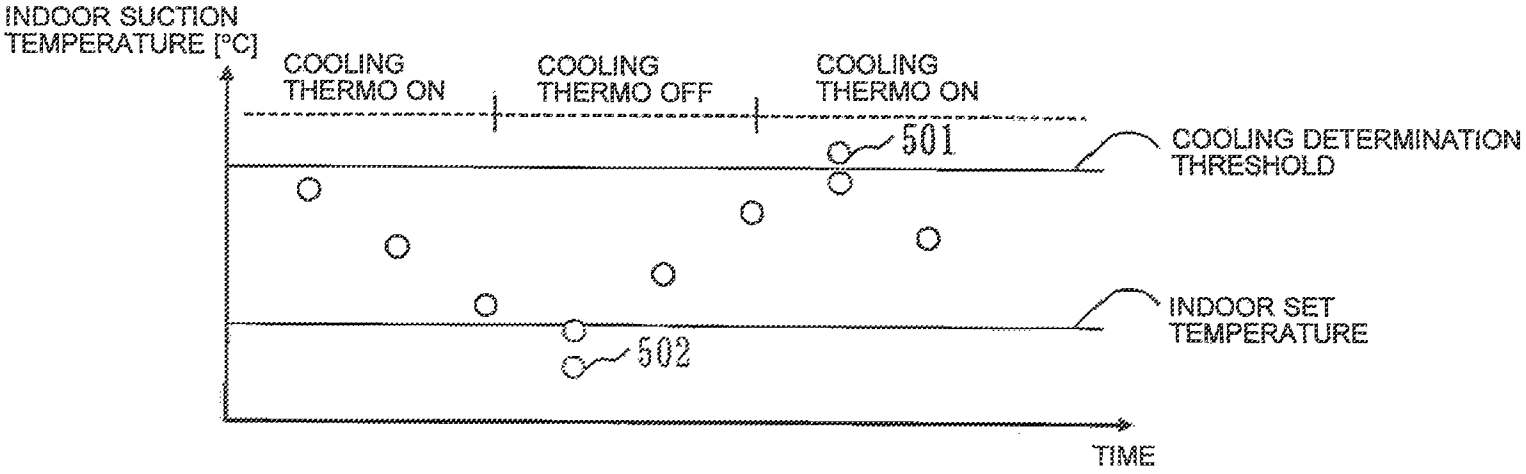
FIG. 12 illustrates variation of indoor suction temperature with time with respect to cooling thermo ON/OFF determination in the hot water supply priority mode of the simultaneous cooling and hot water supply operation mode of the combined air-cooling and hot water supply system 200 according to Embodiment 2.

FIG. 12 illustrates variation of indoor suction temperature with time with respect to cooling thermo ON/OFF determination, in the hot water supply priority mode of the simultaneous cooling and hot water supply operation mode. Two circle marks 501, 502 each indicate the value of indoor suction temperature computed after a predetermined time. The eight circle marks not denoted by symbols indicate actual measurement data. With regard to cooling thermo ON/OFF determination according to the value of indoor suction temperature computed after a predetermined time, the variation of indoor suction temperature with time with respect to cooling thermo ON/OFF determination is illustrated in FIG. 12. It is also possible to store past indoor suction temperature data (an example of suction air temperature variation data) in the memory (storing section 105) in advance, simulate the indoor suction temperature after a predetermined time from the past and current indoor suction temperatures, and use the simulated indoor suction temperature as the criterion for the cooling thermo ON/OFF determination by the control section 103. For example, from the indoor suction temperatures from one minute ago and at present, the indoor suction temperature after one minute is calculated by the computing section 102 by assuming that the indoor suction temperature is proportional to time. The past data to be referenced may be more than a single piece of data. By using as many pieces of data as possible to calculate the indoor suction temperature after a predetermined time, the accuracy of computation is improved. When the indoor suction temperature after a predetermined time becomes lower than the indoor set temperature, the control section 103 turns thermo of the cooling operation OFF, and performs the hot water supply operation. Also, when the indoor suction temperature after a predetermined time becomes higher than a cooling determination threshold, the control section 103 turns the cooling operation thermo ON, and performs the simultaneous cooling and hot water supply operation in hot water supply priority. Through this control, excessive indoor cooling can be prevented, and comfort is not compromised.

In this way, the storing section 105 stores indoor suction temperature data indicative of variation of the suction air temperature of the use unit 303 with elapse of time while a simultaneous operation of the cooling operation and the hot water supply operation is executed.

The computing section 102 simulates the variation of suction air temperature with elapse of time on the basis of the indoor suction temperature data stored in the storing section 105. Then, when executing a simultaneous operation of the cooling operation and the hot water supply operation, the control section 103 stops the cooling operation of the use unit 303 during periods of time in which the suction air temperature simulated by the computing section 102 is lower than the indoor set temperate.

The operation in a case where the simultaneous cooling and hot water supply operation is executed in the cooling priority mode is the same as that in the combined air-conditioning and hot water supply system according to Embodiment 1. That is, the operating frequency of the compressor 1 is determined in accordance with the cooling load in the use unit 303, and thus the cooling capacity and the cooling load become equal. The cooling indoor temperature of the use unit 303 is controlled to the indoor set temperature. When there is no longer hot water supply request from the hot water supply unit 304 and hot water supply is complete, the cooling operation is performed. In this operation, the operating frequency of the compressor 1 is set lower than that during operation in hot water supply priority. Therefore, hot water can be supplied with high efficiency, but the cooling capacity becomes smaller, which means that it takes longer for hot water supply to be completed.

Even in a case where, as in the combined air-conditioning and hot water supply system 200 according to Embodiment 2, waste heat generated in cooling is completely recovered for hot water supply in the simultaneous cooling and hot water supply operation mode, by introducing the priority operation determination threshold 5M as in the combined air-conditioning and hot water supply system 200 according to Embodiment 1, it is possible to appropriately estimate the quantity of heat required for hot water supply. That is, the control section 103 supplies hot water with high efficiency in the cooling priority mode in a case where a small quantity of heat is required for hot water supply, and supplies hot water in the hot water supply priority mode to prevent running out of hot water in a case where a large quantity of heat is required for hot water supply. Also, in the hot water supply priority mode, when the cooling indoor temperature of the use unit 303 becomes lower than the indoor set temperature, the control section 103 turns the cooling thermo OFF and performs the hot water supply operation, and once the cooling indoor temperature becomes higher than the indoor set temperature, the control section 103 executes the hot water supply priority mode of the simultaneous cooling and hot water supply operation again. Therefore, it is possible to shorten the hot water supply time while executing cooling without compromising indoor comfort.

While the combined air-conditioning and hot water supply system 100 (cooling and hot water supply system) has been described in the above embodiments, the operation of the combined air-conditioning and hot water supply system 100 can be also grasped as a cooling and hot water supply method. That is, the operation of the combined air-conditioning and hot water supply system 100 can be grasped as a cooling and hot water supply method in which the controller 103 executes the control described in the above embodiments with respect to a hot water supply device including the heat source unit 301, the use unit 303*a*, 303*b*, the hot water supply unit 304, the measuring section 101, and the like.

REFERENCE SIGNS LIST

1 compressor; 2 first four-way valve; 3 outdoor heat exchanger; 4 outdoor air-sending device; 5 outdoor pressure-reducing mechanism; 6 liquid extension pipe; 7 indoor pressure-reducing mechanism; 8 indoor liquid pipe; 9 indoor heat exchanger; 10 indoor air-sending device; 11 indoor gas pipe; 12 gas extension pipe; 13 second four-way valve; 14 accumulator; 15 hot water supply gas extension pipe; 16 plate water-heat exchanger; 17 water supply pump; 18 hot water supply liquid pipe; 19 hot water supply pressure-reducing mechanism; 20 upstream water pipe; 21 downstream water pipe; 22 air-conditioning discharge solenoid valve; 23 third four-way valve; 24 receiver; 25 hot water supply discharge solenoid valve; 26 hot water supply liquid extension pipe; 27 low-pressure equalizing solenoid valve; 100 combined air-conditioning and hot water supply system; 110 system control device; 101 measuring section; 102 computing section; 103 control section; 104 clock section; 105 storing section; 200 combined air-conditioning and hot water supply system; 201 high-pressure pressure sensor; 202 discharge temperature sensor; 203 outdoor gas temperature sensor; 204 outdoor liquid temperature sensor; 205 outside air temperature sensor; 206 indoor liquid temperature sensor; 207 indoor gas temperature sensor; 208 indoor suction temperature sensor; 209 hot water supply liquid temperature sensor; 210 inlet water temperature sensor; 211 outlet water temperature sensor; 212 first hot water supply tank water temperature sensor; 213 second hot water supply tank water temperature sensor; 214 third hot water supply tank water temperature sensor; 215 fourth hot water supply tank water temperature sensor; 216 water supply temperature sensor; 301 heat source unit; 302 branch unit; 303 use unit; 303-1 display section; 303-2 operating section; 304 hot water supply unit; 304-1 water circuit; 305 hot water supply tank.

The invention claimed is:

1. A cooling and hot water supply system comprising:

a heat source unit that has a compressor whose operating frequency can be controlled and that has and a first heat exchanger;

a use unit that is connected to the heat source unit, the use unit having a second heat exchanger;

a hot water supply unit that is connected to the heat source unit, the hot water supply unit having a water-heat exchanger that heats water in a hot water supply tank by heating water in a water circuit in which the water circulates;

a plurality of temperature sensors that detect at least an inlet water temperature $T_{wi}$ of water entering the water-heat exchanger in the water circuit, a suction air temperature of air sucked by the use unit, and a water temperature in the hot water supply tank; and a control device, the control device is configured to execute a cooling operation mode, execute a simultaneous cooling and hot water supply operation mode, in the simultaneous cooling and hot water supply operation mode, simultaneously execute a cooling operation using the second heat exchanger and a hot water supply operation using the water-heat exchanger, determine whether the control device receives both a cooling request signal that requests the cooling operation of the use unit and a hot water supply request signal that requests the hot water supply operation of the hot water supply unit, when the control device determines that it receives both the cooling request signal that requests the cooling operation of the use unit and the hot water supply request signal that requests the hot water supply operation of the hot water supply unit, execute the simultaneous cooling and hot water supply operation mode and cause a discharge refrigerant discharged from the compressor to pass through the second heat exchanger from the water-heat exchanger, wherein the simultaneous cooling and hot water supply operation mode includes a cooling priority mode and a hot water supply priority mode, while executing the simultaneous cooling and hot water supply operation mode:

the control device judges whether a temperature differential $\Delta T_{wm}$ between a set hot water supply temperature $T_{wset}$ that is held in advance, and the inlet water temperature $T_{wi}$ is smaller than a priority operation determination threshold temperature M that is set in advance, when the temperature differential $\Delta T_{wm}$ is determined to be smaller than the priority operation determination threshold temperature M, the control device performs the cooling priority mode in which the control device controls an operating frequency of the compressor in accordance with a temperature differential between the suction air temperature and a cooling set temperature of the use unit that is held in advance, and when the temperature differential $\Delta T_{wm}$ is determined to be equal to or more than the priority operation determination threshold temperature M, the control device performs the hot water supply priority mode in which the control device controls the operating frequency of the compressor in accordance with a temperature differential between the set hot water supply temperature $T_{wset}$ and the water temperature in the hot water supply tank.

2. The cooling and hot water supply system of claim 1, wherein:

the plurality of temperature sensors include a temperature sensor that detects a temperature of outside air; and the higher the temperature of outside air detected by the temperature sensor, the larger the control device sets the priority operation determination threshold temperature M.

3. The cooling and hot water supply system of claim 1, wherein:

the control device includes a clock section that measures time, and a storing section that stores hot water usage variation data indicating variation of an amount of hot water usage in the hot water supply tank with elapse of time; and the control device sets the priority operation determination threshold temperature M smaller during a time period in which the amount of hot water usage exceeds a predetermined amount in the hot water usage variation data, than during a time period in which the amount of hot water usage does not exceed the predetermined amount.

4. The cooling and hot water supply system of claim 1, wherein the control device receives input of a stored heat quantity stored in the hot water supply tank from a stored heat quantity computing section that computes the stored heat quantity, and the larger the inputted stored heat, the larger the control device sets the priority operation determination threshold temperature M.

5. The cooling and hot water supply system of claim 1, wherein the control device receives input of a remaining amount of hot water remaining in the hot water supply tank from a remaining hot water amount computing section that computes the remaining amount of hot water, and the larger the inputted remaining amount of hot water, the larger the control device sets the priority operation determination threshold temperature M.

6. The cooling and hot water supply system of claim 1, wherein while executing the simultaneous cooling and hot water supply operation mode, the control device receives input of a stored heat quantity stored in the hot water supply tank from a stored heat quantity computing section that computes the stored heat quantity, and executes the hot water supply priority mode when the stored heat quantity inputted from the stored heat quantity computing section is smaller than a predetermined heat quantity.

7. The cooling and hot water supply system of claim 1, wherein while executing the simultaneous cooling and hot water supply operation mode, the control device receives input of a remaining amount of hot water remaining in the hot water supply tank from a remaining hot water amount computing section that computes the remaining amount of hot water, and executes the hot water supply priority mode when the inputted remaining amount of hot water is smaller than a predetermined amount.

8. The cooling and hot water supply system of claim 1 wherein while executing the simultaneous cooling and hot water supply operation mode, when an execution time of the cooling priority mode becomes equal to or more than a predetermined time, the larger the temperature differential $\Delta T_{wm}$, the higher the control device controls the operating frequency of the compressor in the cooling priority mode.

9. The cooling and hot water supply system of claim 1, wherein while executing the cooling priority mode, the control device receives input of a coefficient of performance of the cooling priority mode from a coefficient-of-performance computing section that computes the coefficient of performance, and when the inputted coefficient of performance is equal to or lower than a predetermined value, the control device switches the cooling priority mode that is being executed to the hot water supply priority mode.

10. The cooling and hot water supply system of claim 1, wherein while executing the simultaneous cooling and hot water supply operation mode, the control device receives input of a condensing temperature CT of the first heat exchanger from a condensing temperature computing section that computes the condensing temperature CT, and instead of the temperature differential $\Delta T_{wm}$, the control device uses a temperature differential $\Delta T$ between the set hot water supply temperature $T_{wset}$ and the condensing temperature CT to determine whether to switch to the cooling priority mode or the hot water supply priority mode.

11. The cooling and hot water supply system of claim 1, wherein while executing the simultaneous cooling and hot water supply operation mode, when the suction air temperature of the use unit becomes lower than the cooling set temperature, the control device stops the cooling operation of the use unit until the suction air temperature of the use unit becomes higher than the cooling set temperature.

12. The cooling and hot water supply system of claim 1, wherein the control device is further configured to store, in a storing section, a suction air temperature variation data, the suction air temperature variation data being indicative of variation of the suction air temperature of the use unit with elapse of time while the simultaneous cooling and hot water supply operation mode is executed, and simulate, in a computing section, variation of the suction air temperature with time on a basis of the suction air temperature variation data stored in the storing section, determine whether the suction air temperature simulated by the computer section is lower than the cooling set temperature, when executing the simultaneous cooling and hot water supply operation mode, stop the cooling operation of the use unit during a period in which the suction air temperature simulated by the computing section is determined to be lower than the cooling set temperature.

13. The cooling and hot water supply system of claim 1, wherein:

the use unit further includes a display section that displays whether a current priority mode is the cooling priority mode or the hot water supply priority mode, and an operating section that outputs a switch command signal when a predetermined operation is made on the operating section, the switch command signal commanding switching from the current priority mode displayed on the display section to the other priority mode; and the control device receives input of the switch command signal outputted from the operating section, and switches the current priority mode to the other priority mode upon input of the switch command signal.

14. The cooling and hot water supply system of claim 1, wherein the control device receives input of a switch command signal from a remote control that outputs the switch command signal and has a display section that displays whether a current priority mode is the cooling priority mode or the hot water supply priority mode, the switch command signal commanding switching from the current priority mode displayed on the display section to the other priority mode, and the control device switches the current priority mode to the other priority mode upon input of the switch command signal.

15. A cooling and hot water supply method, with respect to a cooling and hot water supply system including a heat source unit that has a compressor whose operating frequency can be controlled and a first heat exchanger;

a use unit that is connected to the heat source unit, the use unit having a second heat exchanger;

a hot water supply unit that is connected to the heat source unit, the hot water supply unit having a water-heat exchanger that heats water in a hot water supply tank by heating water in a water circuit in which the water circulates;

a plurality of temperature sensors that detect at least an inlet water temperature $T_{wi}$ of water entering the water-heat exchanger in the water circuit, a suction air temperature of air sucked by the use unit, and a water temperature in the hot water supply tank; and a control device, the control device is configured to execute a cooling operation mode, execute a simultaneous cooling and hot water supply operation mode, in the simultaneous cooling and hot water supply operation mode, simultaneously execute a cooling operation using the second heat exchanger and a hot water supply operation using the water-heat exchanger, the method by the control device comprising:

determining, by the control device, whether the control device receives both a cooling request signal that requests the cooling operation of the use unit and a hot water supply request signal that requests the hot water supply operation of the hot water supply unit, when the control device determines that it receives both the cooling request signal that requests the cooling operation of the use unit and the hot water supply request signal that requests the hot water supply operation of the hot water supply unit, executing, by the control device, the simultaneous cooling and hot water supply operation mode and causing a discharge refrigerant discharged from the compressor to pass through the second heat exchanger from the water-heat exchanger;

wherein the simultaneous cooling and hot water supply operation mode includes a cooling priority mode and a hot water supply priority mode, while executing the simultaneous cooling and hot water supply operation mode:

judging, by the control device, whether a temperature differential $\Delta T_{wm}$ between a set hot water supply temperature $T_{wset}$ that is held in advance, and the inlet water temperature $T_{wi}$ is smaller than a priority operation determination threshold temperature M that is set in advance, when the temperature differential $\Delta T_{wm}$ is determined to be smaller than the priority operation determination threshold temperature M, performing, by the control device, the a cooling priority mode in which the control device controls an operating frequency of the compressor in accordance with a temperature differential between the suction air temperature and a cooling set temperature of the use unit that is held in advance, and when the temperature differential $\Delta T_{wm}$ is determined to be equal to or more than the priority operation determination threshold temperature M, performing, by the control device, the hot water supply priority mode in which the control device controls the operating frequency of the compressor in accordance with a temperature differential between the set hot water supply temperature $T_{wset}$ and the water temperature in the hot water supply tank.

* * * * *